US006653922B2

(12) United States Patent
Sano et al.

(10) Patent No.: US 6,653,922 B2
(45) Date of Patent: Nov. 25, 2003

(54) IGNITION COIL

(75) Inventors: Masafuyu Sano, Okazaki (JP); Kazutoyo Osuka, Gamagori (JP); Norihiro Adachi, Kariya (JP); Yoshihiro Shimoide, Aichi-ken (JP); Osamu Sugie, Handa (JP); Kaneo Buma, Oobu (JP); Katsunori Akimoto, Okazaki (JP); Atsuyuki Konishi, Anjo (JP); Masaharu Shimohata, Takahama (JP); Yoshitaka Sato, Toyohashi (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/180,065

(22) Filed: Jun. 27, 2002

(65) Prior Publication Data

US 2003/0076208 A1 Apr. 24, 2003

(30) Foreign Application Priority Data

Oct. 18, 2001 (JP) ..... 2001-321044
Feb. 19, 2002 (JP) ..... 2002-041791
Apr. 26, 2002 (JP) ..... 2002-125330

(51) Int. Cl.[7] ..... H01F 27/02
(52) U.S. Cl. ..... 336/96; 336/90; 336/198
(58) Field of Search ..... 336/65, 90–96, 336/110, 107, 192, 198; 123/634, 635

(56) References Cited

U.S. PATENT DOCUMENTS 5,949,319 A 9/1999 Nuebel et al.
5,977,856 A * 11/1999 Maekawa et al. ..... 336/96
6,337,617 B1 * 1/2002 Kato et al. ..... 336/96
6,469,608 B2 * 10/2002 Shimoide et al. ..... 336/90
6,525,636 B1 * 2/2003 Oosuka et al. ..... 336/90

FOREIGN PATENT DOCUMENTS

JP 2000-501895 2/2000

* cited by examiner

*Primary Examiner*—Tuyen T. Nguyen
(74) *Attorney, Agent, or Firm*—Nixon & Vanderhye P.C.

(57) ABSTRACT

An ignition coil includes a housing which contains a central core portion, an inner spool having a first winding, and an outer spool having a second winding. The inner spool extends outward of the central core portion. The outer spool extends outward of the inner spool. A locating member includes a locating rib adjacent to an upper portion of the central core portion. The locating rib is in a gap between the inner spool and the central core portion, and locates the inner spool and the central core portion relative to each other. Insulating resin injected into the housing provides insulation among parts in the housing. At least one of the inner spool and the locating member has a void-escape passage which connects the gap and an outside of the inner spool with each other, and which allows a void to escape from the injected insulating resin in the gap.

17 Claims, 33 Drawing Sheets

IGNITION COIL

BACKGROUND OF THE INVENTION

1. Field of the Invention

This invention generally relates to an ignition coil. This invention particularly relates to an ignition coil which can be fitted into a plug hole in each cylinder of an internal combustion engine.

2. Description of the Related Art

A typical ignition coil has a housing, a coil portion, and a connector portion. The housing is cylindrical. The coil portion is provided in the housing. The coil portion includes a central core, a primary winding, a primary spool, a secondary winding, and a secondary spool. The primary winding is provided on the primary spool. The secondary winding is provided on the secondary spool. The primary spool and the secondary spool are located coaxially around the central core. The primary spool extends outward of the secondary spool. The primary spool, the secondary spool, and the central core are spaced from each other. Spaces in the housing are occupied by epoxy resin which fixes the parts to each other, and which provides insulation thereamong. During the manufacture of the typical ignition coil, casting epoxy resin is injected into the housing. The connector portion is provided on an upper part of the housing. The connector portion has a locating member. A ring-shaped locating rib extends downward from a lower end surface of the locating member. Voids tend to remain in the epoxy resin after the manufacture of the typical ignition coil. The voids decrease the fixing and insulating performances of the epoxy resin.

U.S. Pat. No. 5,949,319 corresponding to Japanese patent application publication number P2000-501895A discloses a bar coil for use as an ignition coil which is designed as follows. Casting resin can be introduced into an interior space of the bar coil. The bar coil has a centrally arranged channel that extends from a connecting segment, through a core of the bar coil, and to a pan-shaped bottom area of the interior space of the bar coil. During the manufacture of the bar coil, casting resin flowing through the channel enters the closed bottom area, from which it is diverted as a uniform front to flow through gaps in the bar coil to the connecting segment. Specifically, casting resin is introduced directly into the bar coil, downstream of the windings, through a channel which is longer than each of the windings of the bar coil. The casting resin travels from the channel into gaps that are adjacent to the windings. Thus, the bar coil can be filled rapidly, and the casting resin rises as an essentially uniform front back in the opposite direction through the gaps. This prevents air inclusions which would shorten the insulating clearance after curing as bubbles in the casting resin and could thus lead to failure of the bar coil.

SUMMARY OF THE INVENTION

It is an object of this invention to provide an improved ignition coil.

A first aspect of this invention provides an ignition coil comprising a housing; a central core portion located in the housing; an inner spool disposed in the housing and located outward of the central core portion; a first winding provided on the inner spool; an outer spool disposed in the housing and located outward of the inner spool; a second winding provided on the outer spool; a locating member including a locating rib positioned adjacent to an upper portion of the central core portion, the locating rib being provided in a gap between the inner spool and the central core portion and locating the inner spool and the central core portion relative to each other; insulating resin injected into the housing and providing insulation among parts in the housing; wherein at least one of the inner spool and the locating member has a void-escape passage which connects the gap and an outside of the inner spool with each other, and which allows a void to escape from the injected insulating resin in the gap.

A second aspect of this invention is based on the first aspect thereof, and provides an ignition coil wherein the void-escape passage includes a spool-side void-escape hole formed in the inner spool and extending between an inner circumferential surface and an outer circumferential surface of the inner spool.

A third aspect of this invention is based on the first aspect thereof, and provides an ignition coil wherein the void-escape passage includes a spool-side void-escape slit formed in the inner spool and extending between an inner circumferential surface and an outer circumferential surface of the inner spool, the spool-side void-escape slit opening at a top surface of the inner spool.

A fourth aspect of this invention is based on the first aspect thereof, and provides an ignition coil wherein the void-escape passage includes a locating-member-side void-escape hole formed in the locating member and extending through a wall of the locating member at a place inward of the locating rib, the locating-member-side void-escape hole connecting the gap and an outside of the housing.

A fifth aspect of this invention is based on the first aspect thereof, and provides an ignition coil wherein the void-escape passage is formed in the inner spool, and the locating rib has an auxiliary void-escape passage extending between an inner circumferential surface and an outer circumferential surface thereof and communicating with the void-escape passage.

A sixth aspect of this invention is based on the first aspect thereof, and provides an ignition coil wherein the central core portion has a resilient member at its upper end.

A seventh aspect of this invention is based on the first aspect thereof, and provides an ignition coil wherein the void-escape passage includes a spool-side void-escape recess formed in the inner spool.

An eighth aspect of this invention is based on the seventh aspect thereof, and provides an ignition coil wherein the spool-side void-escape recess is formed in an inner circumferential surface of the inner spool.

A ninth aspect of this invention is based on the seventh aspect thereof, and provides an ignition coil wherein the spool-side void-escape recess is formed in an upper end surface of the inner spool.

A tenth aspect of this invention is based on the first aspect thereof, and provides an ignition coil wherein the void-escape passage includes a locating-member-side void-escape recess formed in the locating member.

An eleventh aspect of this invention is based on the tenth aspect thereof, and provides an ignition coil wherein the locating-member-side void-escape recess is formed in an outer circumferential surface of the locating rib.

A twelfth aspect of this invention is based on the tenth aspect thereof, and provides an ignition coil wherein the locating-member-side void-escape recess is near a base of the locating rib.

A thirteenth aspect of this invention is based on the first aspect thereof, and provides an ignition coil wherein the void-escape passage includes a void-escape rib hole formed in the locating rib and extending between an inner circumferential surface and an outer circumferential surface of the locating rib.

A fourteenth aspect of this invention is based on the thirteenth aspect thereof, and provides an ignition coil wherein the locating rib fits into a groove in the locating member.

A fifteenth aspect of this invention is based on the fourteenth aspect thereof, and provides an ignition coil wherein the void-escape rib hole is located at a place where the locating rib fits into the groove in the locating member.

A sixteenth aspect of this invention is based on the thirteenth aspect thereof, and provides an ignition coil wherein the void-escape rib hole communicates with a hole extending through a wall of the locating member.

A seventeenth aspect of this invention is based on the first aspect thereof, and provides an ignition coil wherein an upper end of the central core portion has a small-diameter part, and the locating rib fits around the small-diameter part, and wherein the void-escape passage includes a wide gap defined between an outer circumferential surface of the locating rib and an inner circumferential surface of the inner spool.

DETAILED DESCRIPTION OF THE INVENTION

A prior-art ignition coil will be explained below for a better understanding of this invention.

Figure 36:
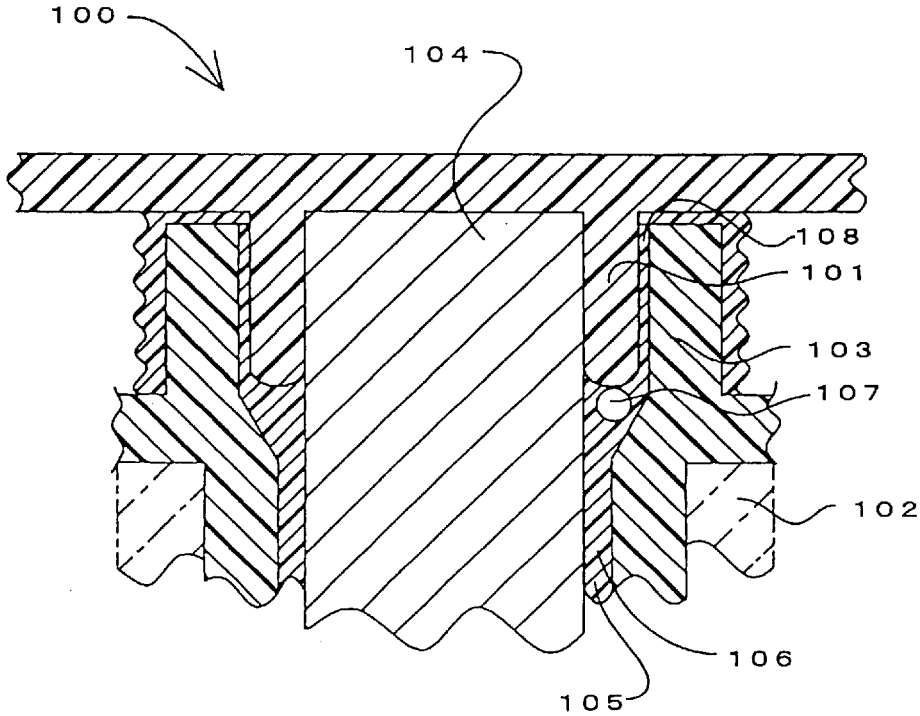
FIG. 36 PRIOR ART
FIG. 36 is a longitudinal section view of a locating member and its neighborhood in a prior-art ignition coil.

FIG. 36 shows a portion of a prior-art ignition coil 100 which includes a locating rib 101, a secondary winding 102, a secondary spool 103, and a central core 104. The locating rib 101 is inserted, from above, into a space between the secondary spool 103 and the central core 104. The locating rib 101 decides the positions of the secondary spool 103 and the central core 104 in an ignition-coil housing. The locating rib 101 causes a gap 105 of a prescribed width to be provided between the secondary spool 103 and the central core 104. The gap 105 is filled with epoxy resin 106 which has cured.

The secondary spool 103 is made of resin. The secondary spool 103 is formed by molding. The central core 104 has a laminate of silicon steel plates. Therefore, the secondary spool 103 and the central core 104 are different in coefficient of linear expansion. The secondary spool 103 and the central core 104 are fixed by the epoxy resin 106 filling the gap 105. The prior-art ignition coil 100 iteratively undergoes a temperature rise and a temperature fall while a related engine is repetitively operated and suspended. Therefore, the secondary spool 103 and the central core 104 iteratively expand and contract in accordance with repetitive changes in temperature of the prior-art ignition coil 100. As the secondary spool 103 and the central core 104 expand and contract, the epoxy resin 106 receives stresses therefrom.

In the prior-art ignition coil 100, a void 107 tends to remain in the epoxy resin 106 after the epoxy resin 106 has cured. The void 107 decreases the performances of the epoxy resin 106 and the secondary spool 103.

In the prior-art ignition coil 100, before the epoxy resin 106 is introduced, there is a gap 108 between the outer circumferential surface of the locating rib 101 and the inner circumferential surface of the secondary spool 103. The gap 108 leads to a space outside the secondary spool 103. The gap 105 between the secondary spool 103 and the central core 104 communicates via the gap 108 with the space outside the secondary spool 103. The gap 108 is so narrow that a void 107 can not escape therethrough toward the space outside the secondary spool 103.

First Embodiment

Figure 1:
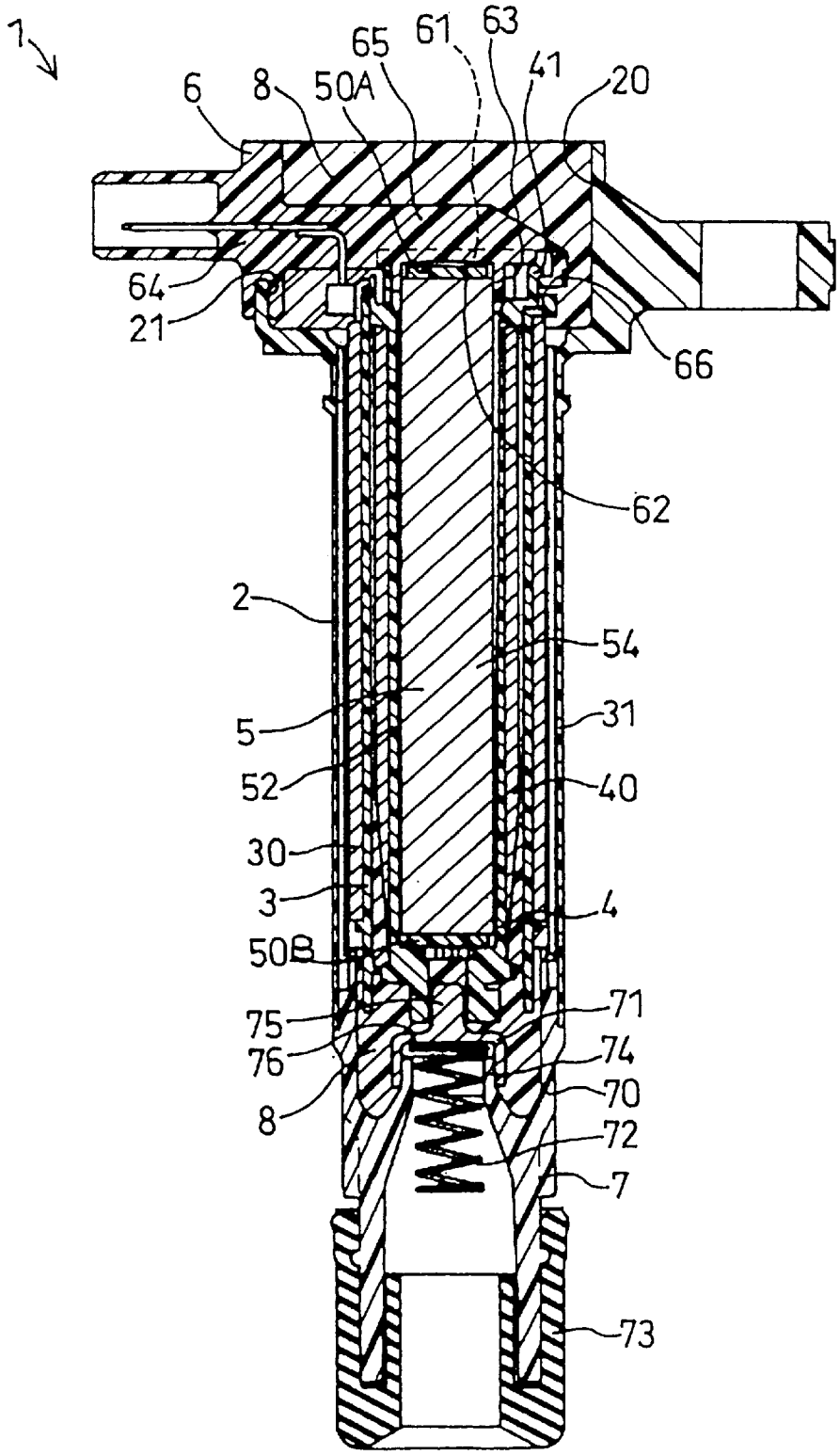
FIG. 1 is a longitudinal section view of an ignition coil according to a first embodiment of this invention.

FIG. 1 shows an ignition coil 1 according to a first embodiment of this invention. The ignition coil 1 relates to an internal combustion engine having an engine block formed with cylinders. An upper portion of the engine block has plug holes for the cylinders respectively. The ignition coil 1 is placed in one plug hole. A lower portion of the ignition coil 1 is connected with a spark plug (not shown).

The ignition coil 1 includes a housing 2. The housing 2 is made of resin. The housing 2 is in the shape of a stepped cylinder having an outside diameter which increases stepwise as viewed in the upward direction. An upper end of the housing 2 which has an increased diameter is formed with a wide-mouthed portion 20. The wide-mouthed portion 20 has a side wall, a part of which is provided with a window 21 formed by cutting.

A primary spool 3, a secondary spool 4, a central core portion 5, a primary winding 30, and a secondary winding 40 are disposed in the housing 2.

The central core portion 5 includes a central core 54, a resilient members 50A and 50B, and a rubber tube 52. The central core 54 has silicon steel plates of strip shapes with different widths which are superposed in a diametrical direction. The central core 4 has a shape of a rod or a bar. The resilient members 50A and 50B are made of silicone rubber. The resilient members 50A and 50B have a shape of a disk or a cylinder. The resilient members 50A and 50B are located at upper and lower ends of the central core 54, respectively. The side surfaces of the central core 54 and the resilient members 50A and 50B are coated with the rubber tube 52.

The secondary spool 4 is made of resin. The secondary spool 4 has a cylindrical shape with a closed bottom. The secondary spool 4 is located coaxially with and adjacently outward of the central core portion 5. The secondary spool 4 corresponds to an inner spool. The secondary winding 40 is provided on the outer circumferential surface of the secondary spool 4. The secondary spool 4 has an upper end surface, from which three spool-side engagement claws 41 extend upward. The spool-side engagement claws 41 are spaced in the circumferential direction.

The primary spool 3 is located coaxially with and adjacently outward of the secondary spool 4. The primary spool 3 corresponds to an outer spool. The primary winding 30 is provided on the outer circumferential surface of the primary spool 3. An outer core 31 of a cylindrical shape is located outward of the primary spool 3. The outer core 31 has a slit or slits extending in the longitudinal direction (the axial direction).

Epoxy resin 8 is provided among the above-mentioned parts in the housing 2. During the manufacture of the ignition coil 1, the interior of the housing 2 is evacuated, and then epoxy prepolymer and curing agent are injected or introduced into the housing 2 via the wide-mouthed portion 20. The epoxy prepolymer and the curing agent fill the spaces among the above-mentioned parts, and the cure occurs so that they form the epoxy resin 8. The epoxy resin 8 fixes the above-mentioned parts to each other, and provides insulation thereamong. The epoxy resin 8 corresponds to insulating resin.

A connector portion 6 is located at the wide-mouthed portion 20 of the housing 2. The connector portion 6 includes a signal input connector 64 and an igniter 65. The signal input connector 64 has a body made of resin. The body of the signal input connector 64 has a shape of a prismatic tube. The signal input connector 64 projects radially outward from the window 21 in the wide-mouthed portion 20. The signal input connector 64 includes an electrical conductor supported by its body and electrically connected with an electrical conductor in the igniter 65.

The igniter 65 has a body made of resin which supports its electrical conductor. The igniter 65 has a shape of a rectangular parallelepiped. The igniter 65 is located approximately at a central area of the wide-mouthed portion 20. The body of the igniter 65 is integral with a smaller-diameter end of the body of the signal input connector 64. The electrical conductor in the igniter 65 is electrically connected with the primary winding 30.

A locating member 61 denoted by the broken lines in FIG. 1 is made of resin. The locating member 61 is positioned below the igniter 65. The locating member 61 is integral with the body of the igniter 65. A lower potion of the body of the igniter 65 is provided with three locating-member-side engagement claws 66 spaced in the circumferential direction. The locating-member-side engagement claws 66 mesh or connect with the spool-side engagement claws 41, respectively. The mesh or connection between the locating-member-side engagement claws 66 and the spool-side engagement claws 41 brings the secondary spool 4 into engagement with the locating member 61. The locating member 61 has a lower end surface 62, from which a ring-shaped locating rib 63 extends downward. The locating rib 63 is inserted, from above, into a gap between the secondary spool 4 and the resilient member 50A of the central core portion 5. The insertion of the locating rib 63 decides the relative positions of the secondary spool 4 and the central core portion 5 in the housing 2. The inserted locating rib 63 causes a gap to be provided between the secondary spool 4 and the central core portion 5.

A high-voltage tower portion 7 is mounted on a lower end of the housing 2. The high-voltage tower portion 7 includes a tower housing 70, a high-voltage terminal 71, a spring 72, and a plug cap 73.

The tower housing 70 is made of resin. The tower housing 70 has a cylindrical shape. The inner part of an intermediate portion of the tower housing 70 has a boss portion 74 projecting upward. The boss portion 74 has an outside diameter which continuously decreases as viewed in the upward direction.

The high-voltage terminal 71 has a cup shape. A lower portion of the high-voltage terminal 71 has a recess or an opening 76 into which the boss portion 74 is inserted and fitted. Thus, the high-voltage terminal 71 is like an inverted cup with respect to the boss portion 74. A cylindrical projection 75 extends upward from a central part of an upper surface of the inverted-cup portion of the high-voltage terminal 71. The projection 75 is inserted and fitted into a hole in a lower end of the secondary spool 4. The projection 75 is electrically connected with the secondary winding 40.

The spring 72 made of metal has a helical shape. An upper end of the spring 72 located in the recess 76 of the high-voltage terminal 71 is attached and electrically connected to the wall of the high-voltage terminal 71. A spark plug (not shown) is pressed against a lower end of the spring 72. Thus, the spark plug is electrically connected with the spring 72.

The plug cap 73 is made of rubber. The plug cap 73 has a cylindrical shape. The plug cap 73 is fitted around a lower end of the tower housing 70. The spark plug is pressed and resiliently abutted against the inner circumferential surface of the plug cap 73.

The ignition coil 1 operates as follows. A control signal is transmitted to the primary winding 30 via the electrical conductors in the signal input terminal 64 and the igniter 65. Mutual induction responsive to the control signal causes a high voltage across the secondary winding 40. The high voltage is transmitted from the secondary winding 40 to the spark plug via the high-voltage terminal 71 and the spring 72. The high voltage causes a spark in the gap of the spark plug.

Figure 2:
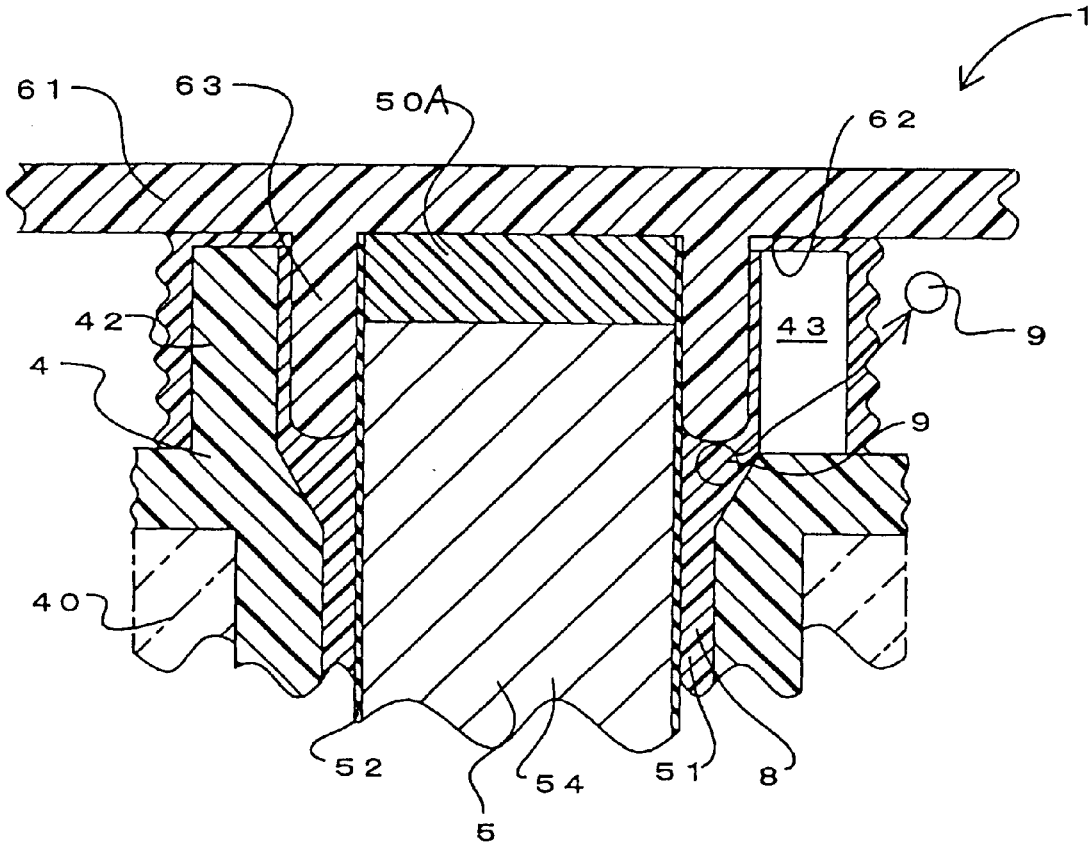
FIG. 2 is an enlarged section view of a locating member and its neighborhood in FIG. 1.

FIG. 2 shows the locating member 61 and its neighborhood. As shown in FIG. 2, the locating rib 63 is provided between the resilient member 50A and the secondary spool 4. An upper end 42 of the secondary spool 4 has spool-side void-escape slits 43. Each spool-side void-escape slit 43 extends through the side wall of the upper end 42 of the secondary spool 4. Thus, the spool-side void-escape slit 43 extends between the inner circumferential surface and the outer circumferential surface of the upper end 42 of the secondary spool 4. The spool-side void-escape slit 43 has a relatively great axial dimension (a relatively great vertical dimension). In other words, the spool-side void-escape slit 43 is elongated in the axial direction (the vertical direction or the longitudinal direction). An upper end of the spool-side void-escape slit 43 is open at the top surface of the upper end 42 of the secondary spool 4.

Figure 3:
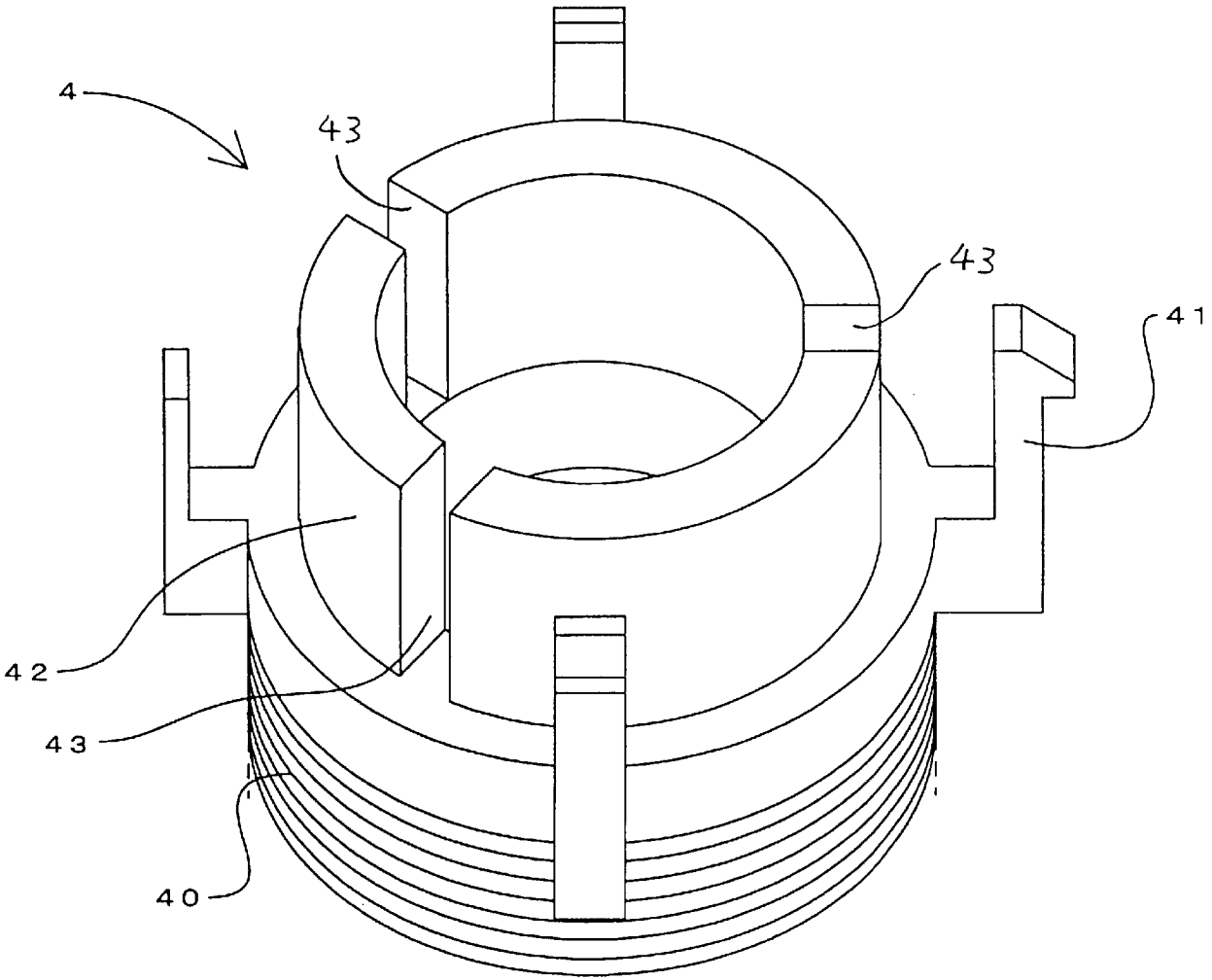
FIG. 3 is a perspective view of an upper end of a secondary spool in FIG. 1.

As shown in FIG. 3, there are three spool-side void-escape slits 43 in the upper end 42 of the secondary spool 4 which are spaced at 120° intervals in the circumferential direction. As shown in FIG. 2, a tubular gap 51 is formed between the central core portion 5 and the secondary spool 4 in a region mostly below the locating rib 63. The spool-side void-escape slits 43 are in communication with the gap 51. The epoxy resin 8 fills the gap 51.

During the manufacture of the ignition coil 1, epoxy prepolymer and curing agent are used as materials for the epoxy resin 8. After the parts are disposed in and mounted on the housing 2 as shown in FIG. 1, epoxy prepolymer and curing agent are injected into the interior of the housing 2 via the wide-mouthed portion 20 of the housing 2. The injected epoxy prepolymer and curing agent flow downward along the inner circumferential surface of the housing 2, reaching a bottom of the interior of the housing 2 and moving through a region between the secondary spool 4 and the high-voltage terminal 71 before flowing upward into the gap 51 in FIG. 2.

In the event that a void 9 (see FIG. 2) exists in the injected epoxy prepolymer and curing agent in the gap 51 before the cure occurs, the void 9 moves to the outside of the secondary spool 4 through one of the spool-side void-escape slits 43. Then, the void 9 moves to the outside of the housing 2 through the wide-mouthed portion 20. Accordingly, the void 9 is prevented from remaining in the epoxy resin 8 after the cure occurs. Here, the void 9 includes a bubble. Each of the spool-side void-escape slits 43 is elongated in the vertical direction. Therefore, even when there are voids in the injected epoxy prepolymer and curing agent at different vertical positions, the voids can surely move to the outside of the secondary spool 4 via the spool-side void-escape slits 43. Accordingly, even in such a case, the voids are prevented from remaining in the epoxy resin 8 after the cure occurs.

Second Embodiment

A second embodiment of this invention is similar to the first embodiment thereof except for a design change mentioned hereafter.

Figure 4:
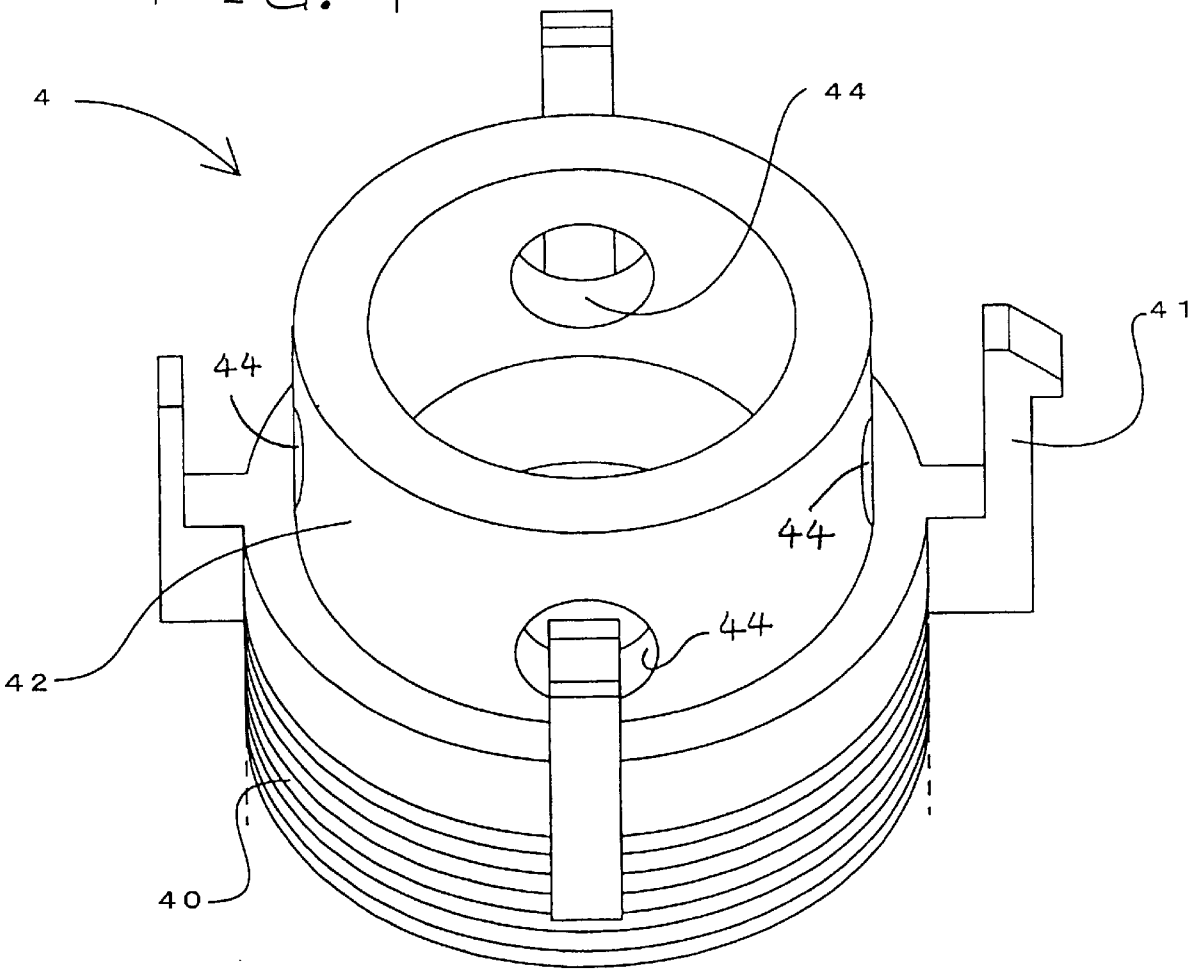
FIG. 4 is a perspective view of an upper end of a secondary spool in an ignition coil according to a second embodiment of this invention.

FIG. 4 shows an upper portion of a secondary spool 4 in the second embodiment of this invention. As shown in FIG. 4, an upper end 42 of the secondary spool 4 has four spool-side void-escape holes 44 which are spaced at 90° intervals in the circumferential direction. The spool-side void-escape holes 44 replace the spool-side void-escape slits 43 (see FIGS. 2 and 3). The spool-side void-escape holes 44 prevent voids from remaining in epoxy resin.

Third Embodiment

A third embodiment of this invention is similar to the first embodiment thereof except for a design change mentioned hereafter.

Figure 5:
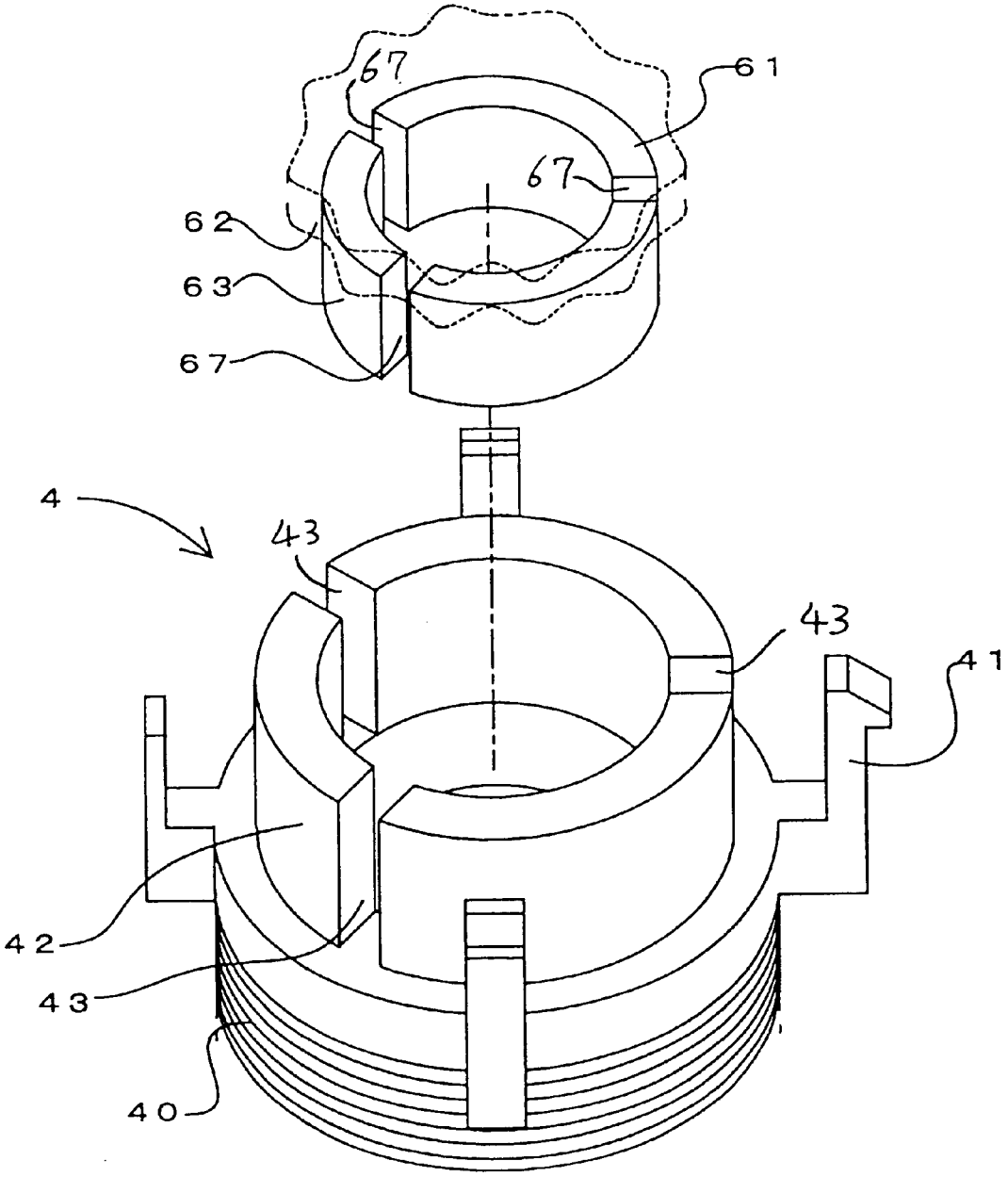
FIG. 5 is an exploded perspective view of a locating rib and an upper end of a secondary spool in an ignition coil according to a third embodiment of this invention.

FIG. 5 shows a locating rib 63 and an upper portion of a secondary spool 4 in the third embodiment of this invention. As shown in FIG. 5, an upper end 42 of the secondary spool 4 has three spool-side void-escape slits 43. This arrangement is similar to that in the first embodiment of this invention.

As shown in FIG. 5, the locating rib 63 has three auxiliary void-escape slits 67 spaced at 120° intervals in the circumferential direction. Each auxiliary void-escape slit 67 extends through the side wall of the locating rib 63. Thus, the auxiliary void-escape slit 67 extends between the inner circumferential surface and the outer circumferential surface of the locating rib 63. The auxiliary void-escape slit 67 has a relatively great axial dimension (a relatively great vertical dimension). In other words, the auxiliary void-escape slit 67 is elongated in the axial direction (the vertical direction or the longitudinal direction). A lower end of the auxiliary void-escape slit 67 is open at the lower end surface of the locating rib 63.

Figure 6:
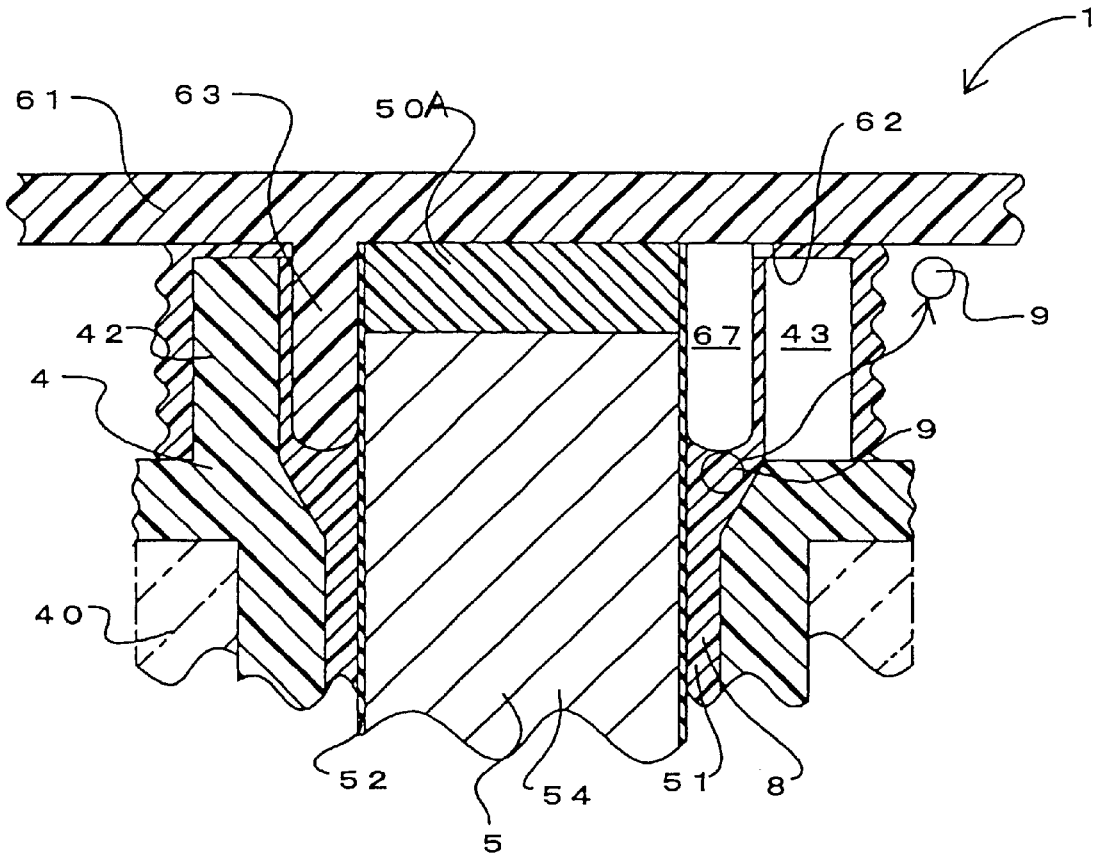
FIG. 6 is a longitudinal section view of a locating member and its neighborhood in the ignition coil of the third embodiment of this invention.

FIG. 6 shows a locating member 61 and its neighborhood in the third embodiment of this invention. As shown in FIG. 6, the auxiliary void-escape slits 67 radially align with the spool-side void-escape slits 43, respectively. Thus, the auxiliary void-escape slits 67 communicate with the spool-side void-escape slits 43, respectively. The gap 51 between the central core portion 5 and the secondary spool 4 is in communication with the outside of the secondary spool 4 via the spool-side void-escape slits 43 and the auxiliary void-escape slits 67. The spool-side void-escape slits 43 and the auxiliary void-escape slits 67 allow a void 9 to escape from injected epoxy prepolymer and curing agent in the gap 51 to the outside of the secondary spool 4. The auxiliary void-escape slits 67 enhance the degree to which voids are prevented from remaining in the epoxy resin 8.

Fourth Embodiment

A fourth embodiment of this invention is similar to the first embodiment thereof except for design changes mentioned hereafter. The resilient member 50A (see FIG. 2) and the spool-side void-escape slits 43 (see FIGS. 2 and 3) are omitted from the fourth embodiment of this invention.

Figure 7:
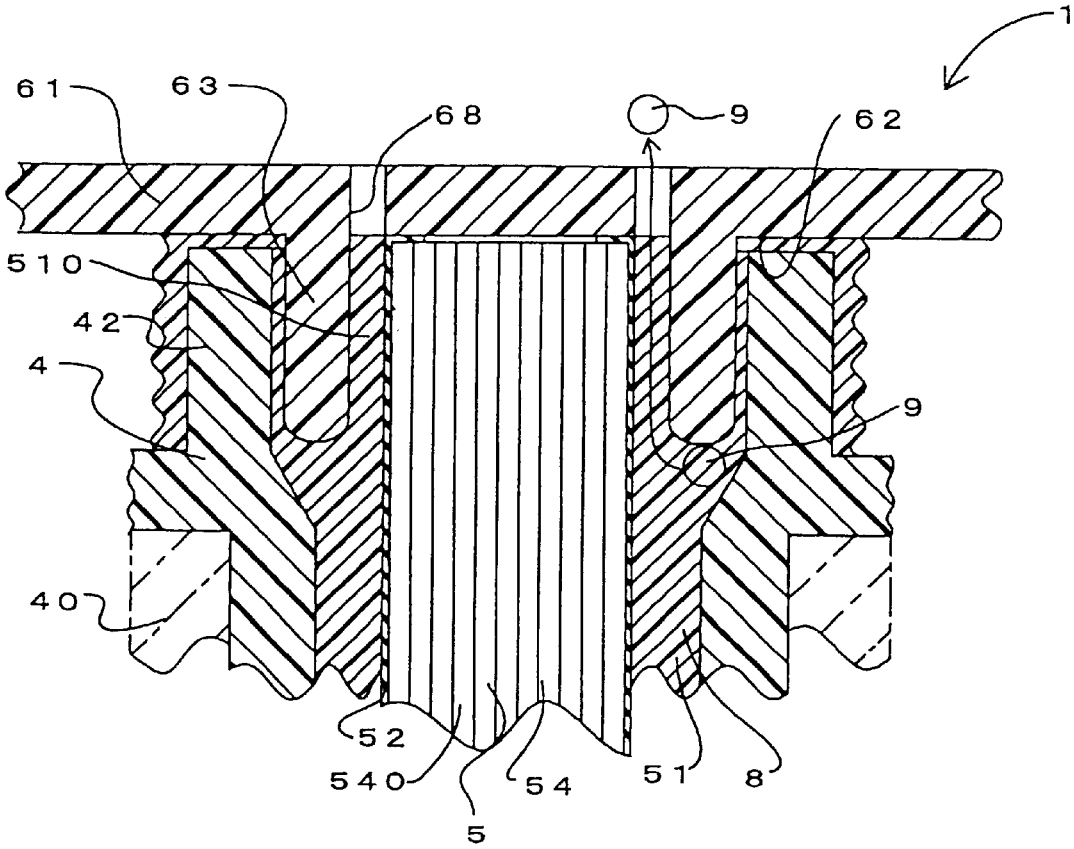
FIG. 7 is a longitudinal section view of a locating member and its neighborhood in an ignition coil according to a fourth embodiment of this invention.
Figure 8:
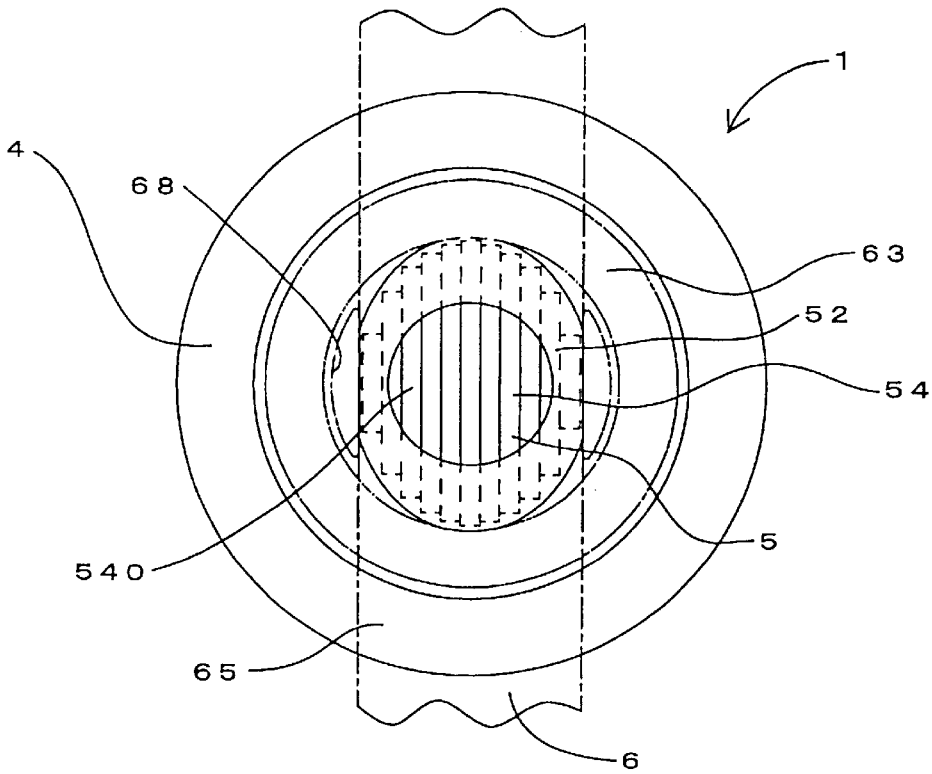
FIG. 8 is a top view of a central core portion and its neighborhood in the ignition coil of the fourth embodiment of this invention.

FIG. 7 shows a locating member 61 and its neighborhood in the fourth embodiment of this invention. FIG. 8 shows a central core portion 5 and its neighborhood in the fourth embodiment of this invention.

As shown in FIG. 8, silicon steel plates 540 are superposed in a diametrical direction to compose a central core 54. The cross section of the central core 54 (or the cross-section of the central core portion 5) is in the shape of an ellipse having a minor axis along the direction in which the silicon steel plates 540 are superposed, and a major axis along the direction in which each layer being one silicon steel plate 540 extends. On the other hand, the inner circumferential surface of a locating rib 63 is circular.

Therefore, as shown in FIG. 7, a relatively wide gap 510 is formed between the inner circumferential surface of the locating rib 63 and each of the minor-axis-direction ends of the central core portion. The gaps 510 communicate with the gap 51 between the central core portion 5 and the secondary spool 4.

The locating member 61 has locating-member-side void-escape holes 68 axially extending through the wall thereof. As viewed from the top, the positions of the locating-member-side void-escape holes 68 are inward of the locating rib 63. The locating-member-side void-escape holes 68 axially align and communicate with the gaps 510, respectively. As shown in FIG. 8, the locating-member-side void-escape holes 68 open into the outside of the ignition-coil housing at sides of the igniter 65 of the connector portion 6, that is, the upper side or the outside of the locating member 61. A void 9 moves upward from injected epoxy prepolymer and curing agent in the gap 51 to the upper side of the locating member 61 via one of the gaps 510 and a related locating-member-side void-escape hole 68. Accordingly, the locating-member-side void-escape holes 68 prevent voids from remaining in the epoxy resin 8.

Fifth Embodiment

A fifth embodiment of this invention is similar to the first embodiment thereof except for design changes mentioned hereafter.

Figure 9:
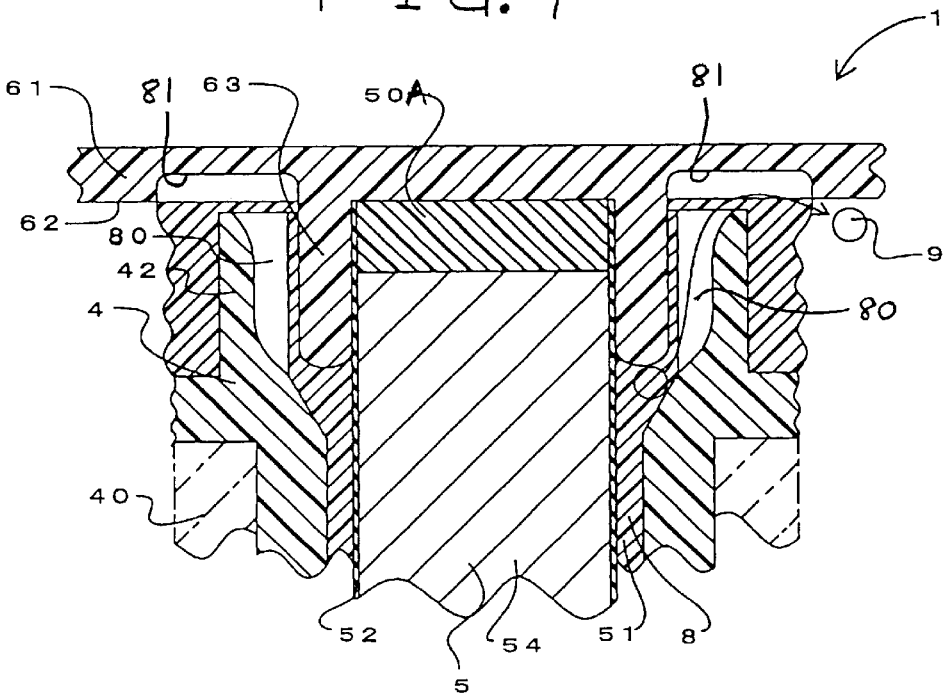
FIG. 9 is a longitudinal section view of a locating member and its neighborhood in an ignition coil according to a fifth embodiment of this invention.
Figure 10:
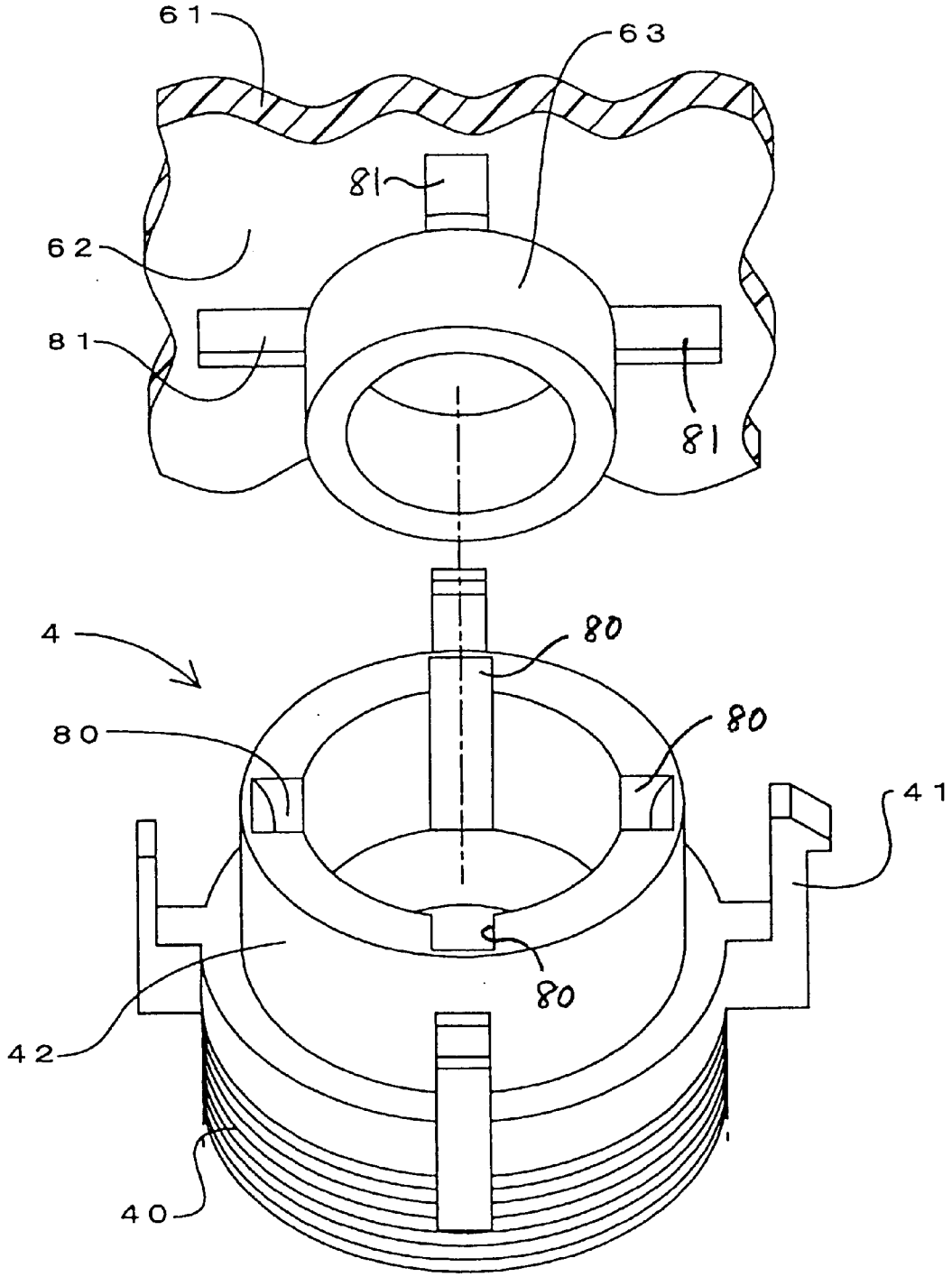
FIG. 10 is an exploded perspective view of the locating member and an upper portion of a secondary spool in the ignition coil of the fifth embodiment of this invention.

FIG. 9 shows a locating member 61 and its neighborhood in the fifth embodiment of this invention. FIG. 10 shows the locating member 61 and an upper portion of a secondary spool 4 in the fifth embodiment of this invention.

As shown in FIG. 9, four spool-side void-escape recesses (grooves) 80 are formed in the inner circumferential surface of an upper end 42 of the secondary spool 4. The spool-side void-escape recesses 80 extend vertically or axially. The spool-side void-escape recesses 80 provide widened gap portions between the outer circumferential surface of the locating rib 63 and the inner circumferential surface of the upper end 42 of the secondary spool 4. As shown in FIG. 10, the spool-side void-escape recesses 80 are spaced at 90° intervals in the circumferential direction. The spool-side void-escape recesses 80 are in communication with the gap 51 between the central core portion 5 and the secondary spool 4.

As shown in FIG. 9, four locating-member-side void-escape recesses (grooves) 81 are formed in the lower end surface 62 of the locating member 61 which extends outward of the locating rib 63. The locating-member-side void-escape recesses 81 extend radially. The locating-member-side void-escape recesses 81 lead to the outside of the secondary spool 4. The locating-member-side void-escape recesses 81 provide widened gap portions between the lower end surface 62 of the locating member 61 and the top surface of the upper end 42 of the secondary spool 4. The locating-member-side void-escape recesses 81 are spaced at 90° intervals in the circumferential direction. Inner portions of the locating-member-side void-escape recesses 81 axially align with the spool-side void-escape recesses 80, respectively. Thus, the inner portions of the locating-member-side void-escape recesses 81 oppose the spool-side void-escape recesses 80, respectively. Accordingly, the locating-member-side void-escape recesses 81 communicate with the spool-side void-escape recesses 80, respectively.

During the manufacture of the ignition coil 1, a void 9 moves upward from injected epoxy prepolymer and curing agent in the gap 51 to one of the locating-member-side void-escape recesses 81 through a related spool-side void-escape recess 80. Then, the void 9 moves along the locating-member-side void-escape recess 81 and reaches the outside of the secondary spool 4. Accordingly, the spool-side void-escape recesses 80 and the locating-member-side void-escape recesses 81 prevent voids from remaining in the epoxy resin 8.

Sixth Embodiment

A sixth embodiment of this invention is similar to the fifth embodiment thereof except for design changes mentioned hereafter.

Figure 11:
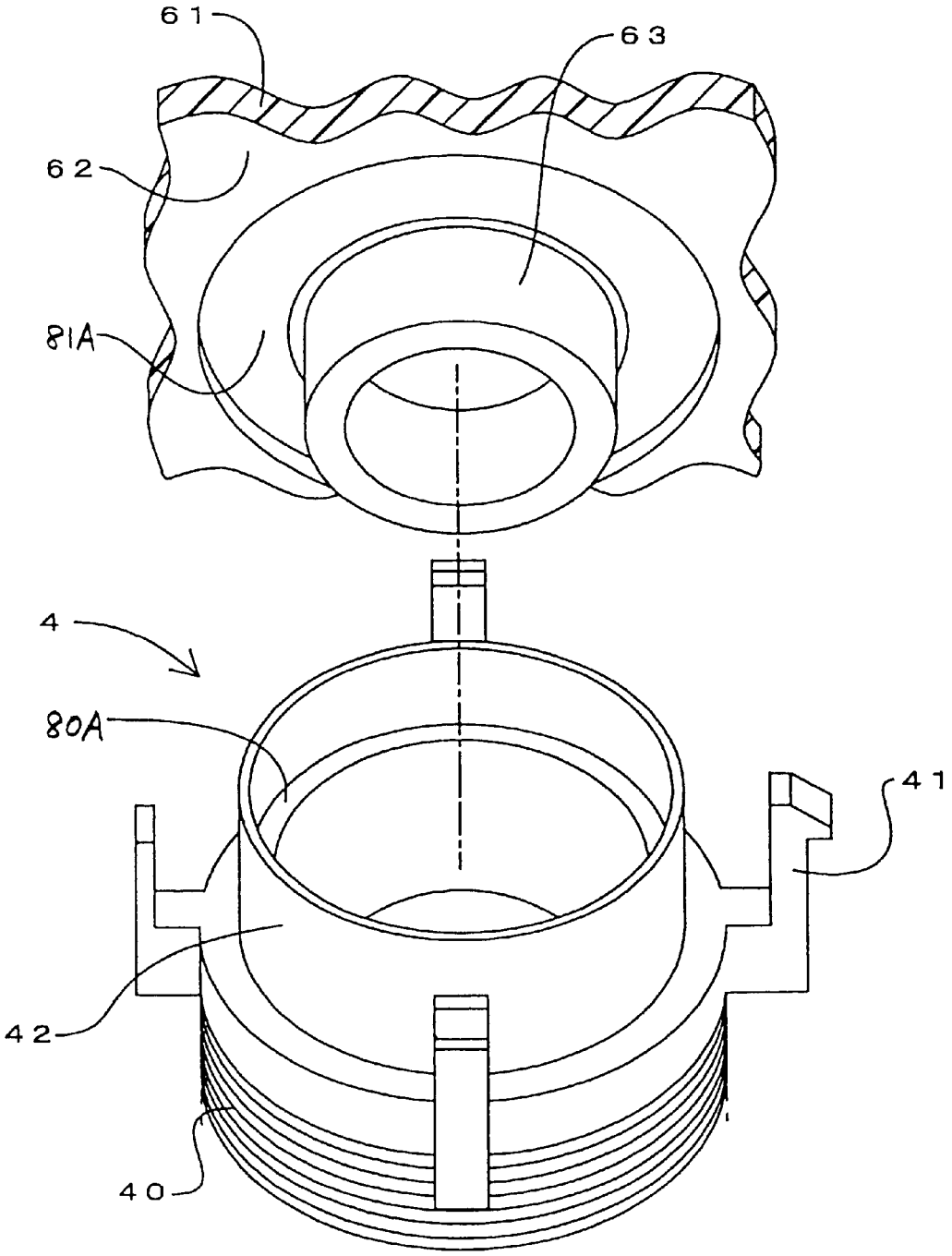
FIG. 11 is an exploded perspective view of a locating member and an upper portion of a secondary spool in an ignition coil according to a sixth embodiment of this invention.

FIG. 11 shows a locating member 61 and an upper portion of a secondary spool 4 in the sixth embodiment of this invention. As shown in FIG. 11, a spool-side void-escape recess 80A is formed in the inner circumferential surface of an upper end 42 of the secondary spool 4. The spool-side void-escape recess 80A is in the shape of a ring. The spool-side void-escape recess 80A is in communication with the gap 51 (see FIG. 9) between the central core portion 5 and the secondary spool 4. A locating-member-side void-escape recess 81A is formed in the lower end surface 62 of the locating member 61 which extends outward of the locating rib 63. The locating-member-side void-escape recess 81A is in the shape of a ring. An inner circumferential portion of the locating-member-side void-escape recess 81A axially aligns with the spool-side void-escape recess 80A. Thus, the inner circumferential portion of the locating-member-side void-escape recess 81A opposes the spool-side void-escape recess 80A. Accordingly, the locating-member-side void-escape recess 81A communicates with the spool-side void-escape recess 80A.

The spool-side void-escape recess 80A extends throughout the circumference of a circle. Also, the locating-member-side void-escape recess 81A extends throughout the circumference of a circle. Therefore, even when there are voids in the injected epoxy prepolymer and curing agent at different circumferential positions, the voids can surely move to the outside of the secondary spool 4 via the spool-side void-escape recess 80A and the locating-member-side void-escape recess 81A. Accordingly, even in such a case, the voids are prevented from remaining in the epoxy resin 8 after the cure occurs.

Seventh Embodiment

A seventh embodiment of this invention is similar to the first embodiment thereof except that spool-side void-escape holes replace the spool-side void-escape slits 43 (see FIGS. 2 and 3).

Figure 12:
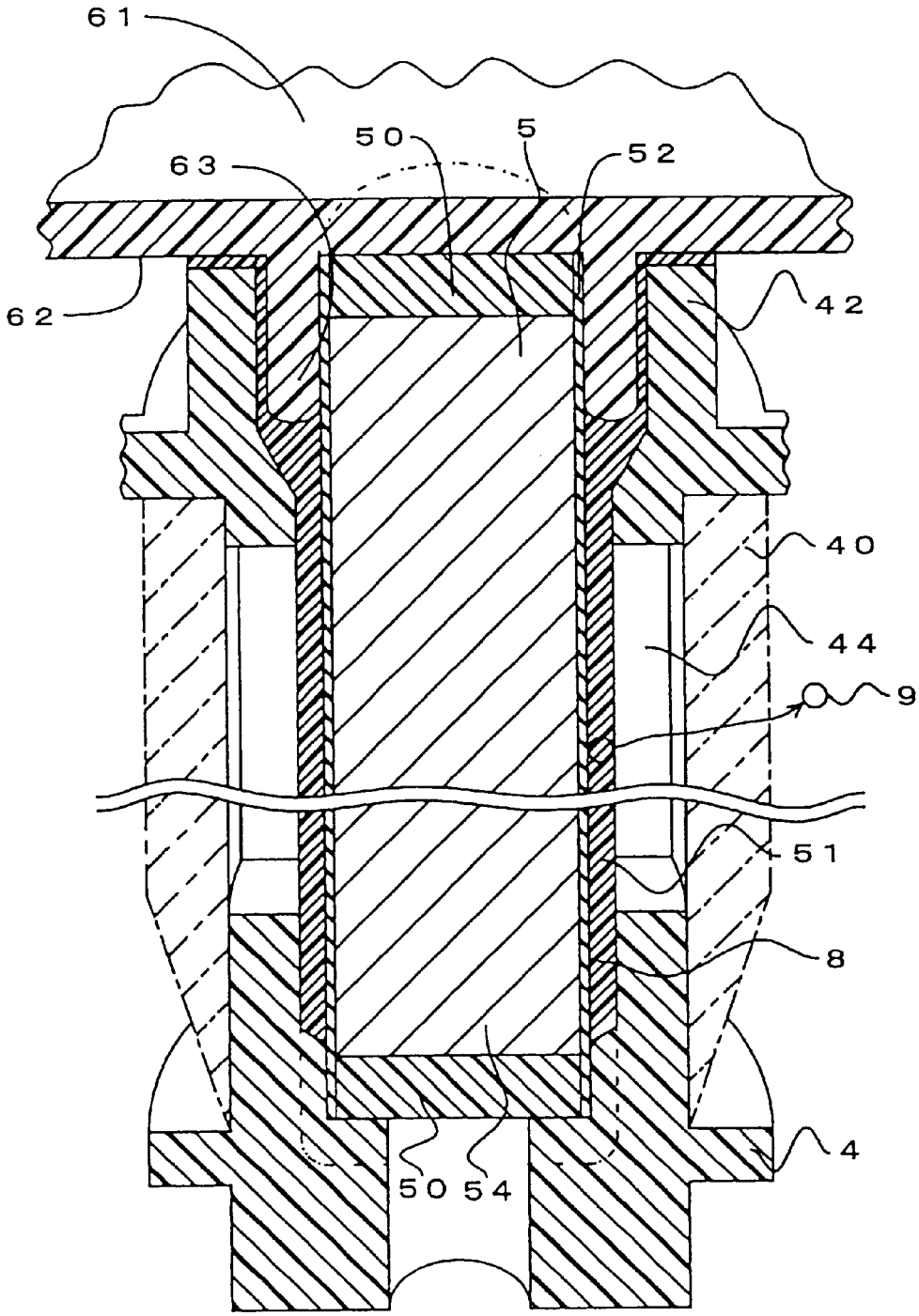
FIG. 12 is a longitudinal section view of a secondary spool and its neighborhood in an ignition coil according to a seventh embodiment of this invention.

FIG. 12 shows a secondary spool 4 and its neighborhood in the seventh embodiment of this invention. As shown in FIG. 12, an intermediate portion of the secondary spool 4 has two spool-side void-escape holes 44 extending through the side wall thereof. The spool-side void-escape holes 44 also extend in the vertical direction or the axial direction with respect to the secondary spool 4. The spool-side void-escape holes 44 are diametrically opposed to each other. In other words, the spool-side void-escape holes 44 are spaced at a 180° interval in the circumferential direction. The spool-side void-escape holes 44 are in communication with the gap 51 between the central core portion 5 and the secondary spool 4.

A void 9 moves from injected epoxy prepolymer and curing agent in the gap 51 to the outside of the secondary spool 4 via one of the spool-side void-escape holes 44. Then, the void 9 moves through gaps among the wires of the secondary winding 40, and reaches the outside of the secondary winding 40. The spool-side void-escape holes 44 extend radially outward of the gap 51. Therefore, the void 9 immediately enters one of the spool-side void-escape holes 44 without moving upward. Then, the void 9 moves to the outside of the secondary spool 4. Thus, the distance traveled by the void 9 is relatively short. Accordingly, the void 9 can quickly escape from the injected epoxy prepolymer and curing agent.

Eighth Embodiment

An eighth embodiment of this invention is similar to the first embodiment thereof except that spool-side void-escape recesses (grooves) replace the spool-side void-escape slits 43 (see FIGS. 2 and 3).

Figure 13:
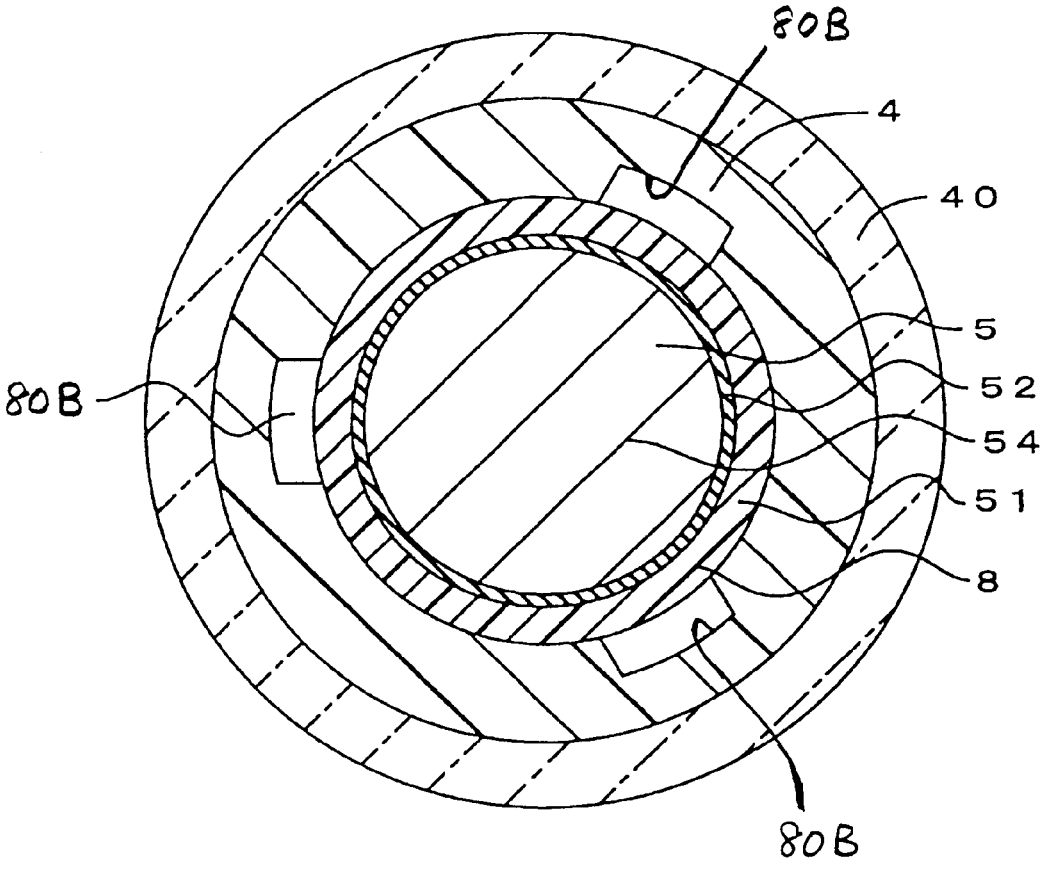
FIG. 13 is a cross-sectional view of a secondary spool and its neighborhood in an ignition coil according to an eighth embodiment of this invention.
Figure 14:
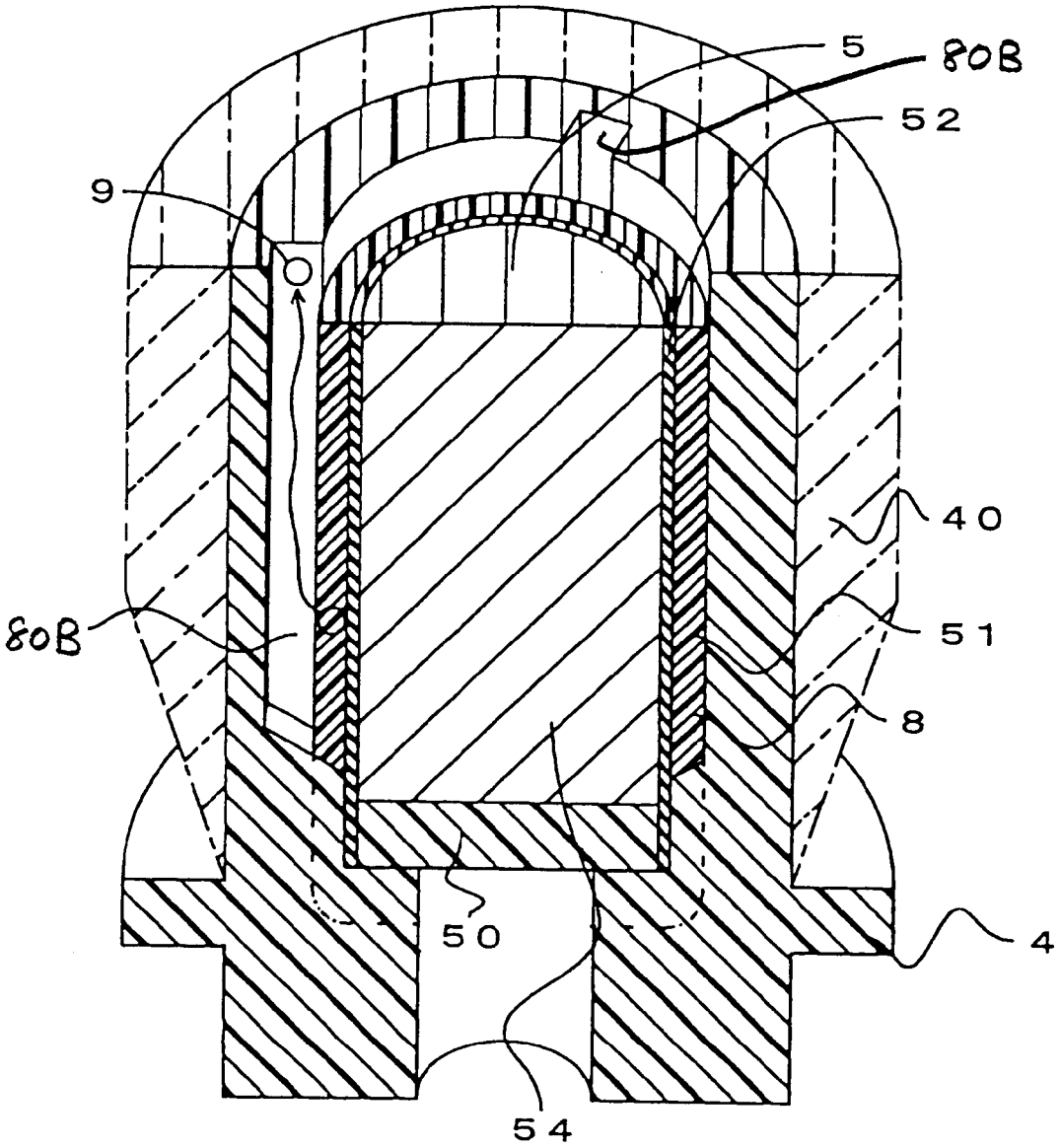
FIG. 14 is a longitudinal section view of a lower portion of the secondary spool and its neighborhood in the ignition coil of the eighth embodiment of this invention.

FIG. 13 shows a secondary spool 4 and its neighborhood in the eighth embodiment of this invention. FIG. 14 shows a lower portion of the secondary spool 4 and its neighborhood in the eighth embodiment of this invention.

As shown in FIGS. 13 and 14, three spool-side void-escape recesses (grooves) 80B are formed in the inner circumferential surface of the secondary spool 4. The spool-side void-escape recesses 80B extend vertically or axially. The spool-side void-escape recesses 80B reach a bottom portion of the secondary spool 4. Each of the spool-side void-escape recesses 80B has a U-shaped cross section. The spool-side void-escape recesses 80B are in communication with the gap 51. The spool-side void-escape recesses 80B provide widened portions in the gap 51 between the central core portion 5 and the secondary spool 4. The spool-side void-escape recesses 80B are spaced at 120° intervals in the circumferential direction. Upper ends of the spool-side void-escape recesses 80B communicate with the outside of the secondary spool 4.

As shown in FIG. 14, a void 9 in injected epoxy prepolymer and curing agent in the gap 51 moves upward along one of the spool-side void-escape recesses 80B before reaching the outside of the secondary spool 4. The spool-side void-escape recess 80B facilitates the upward movement of the void 9. Therefore, a void 9 occurring in a lower portion of the gap 51 can quickly move upward and escape to the outside of the secondary spool 4.

Ninth Embodiment

A ninth embodiment of this invention is similar to the eighth embodiment thereof except for a design change mentioned hereafter.

Figure 15:
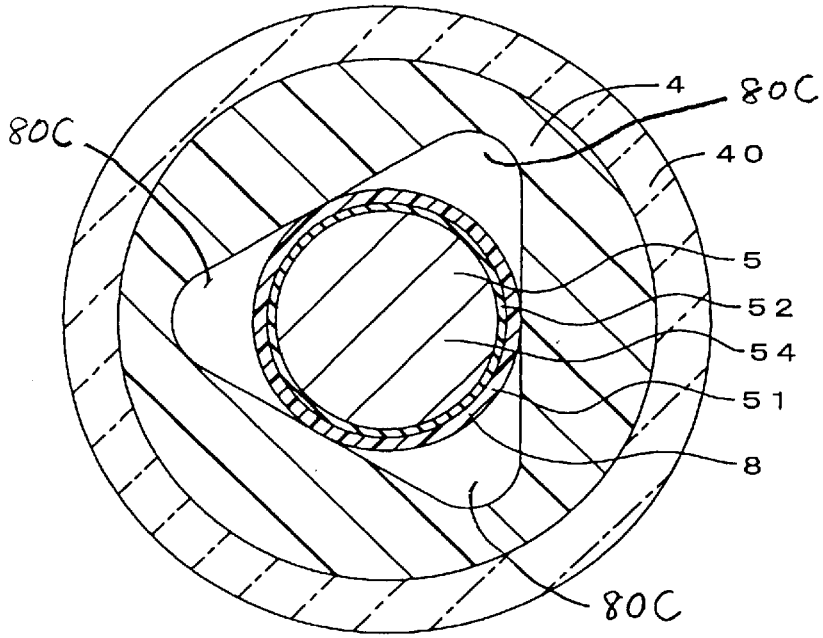
FIG. 15 is a cross-sectional view of a secondary spool and its neighborhood in an ignition coil according to a ninth embodiment of this invention.

FIG. 15 shows a secondary spool 4 and its neighborhood in the ninth embodiment of this invention. As shown in FIG. 15, the secondary spool 4 has an axially-extending inner space with an equilateral-triangular cross section. On the other hand, the outer circumferential surface of the rubber tube 52 of the central core portion 5 is circular. Therefore, at each of the vertexes of the equilateral-triangular cross section of the inner space of the secondary spool 4, a relatively wide gap is formed between the inner surface of the secondary spool 4 and the outer surface of the rubber tube 52. The relatively wide gap constitutes a spool-side void-escape recess (groove) 80C having an approximately triangular cross section.

In other words, the inner surface of the secondary spool 4 differs from a concentric circle with respect to the central core portion 5 so that relatively wide gaps are formed between the inner surface of the secondary spool 4 and the outer surface of the central core portion 5. The relatively wide gaps constitute spool-side void-escape recesses 80C, respectively.

The spool-side void-escape recesses 80C extend vertically or axially. The spool-side void-escape recesses 80C reach a bottom portion of the secondary spool 4. The spool-side void-escape recesses 80C are spaced at 120° intervals in the circumferential direction. The spool-side void-escape recesses 80C are in communication with the gap 51 between the central core portion 5 and the secondary spool 4. Upper ends of the spool-side void-escape recesses 80C communicate with the outside of the secondary spool 4.

A void in injected epoxy prepolymer and curing agent in the gap 51 moves upward along one of the spool-side void-escape recesses 80C before reaching the outside of the secondary spool 4. The spool-side void-escape recess 80C facilitates the upward movement of the void. Therefore, a void occurring in a lower portion of the gap 51 can quickly move upward and escape to the outside of the secondary spool 4.

Merely shaping the cross section of the inner space of the secondary spool 4 into a triangle causes the spool-side void-escape recesses 80C. Thus, it is relatively easy to make the spool-side void-escape recesses 80C.

Tenth Embodiment

A tenth embodiment of this invention is similar to the first embodiment thereof except that void-escape holes in a locating member replaces the spool-side void-escape slits 43 (see FIGS. 2 and 3).

Figure 16:
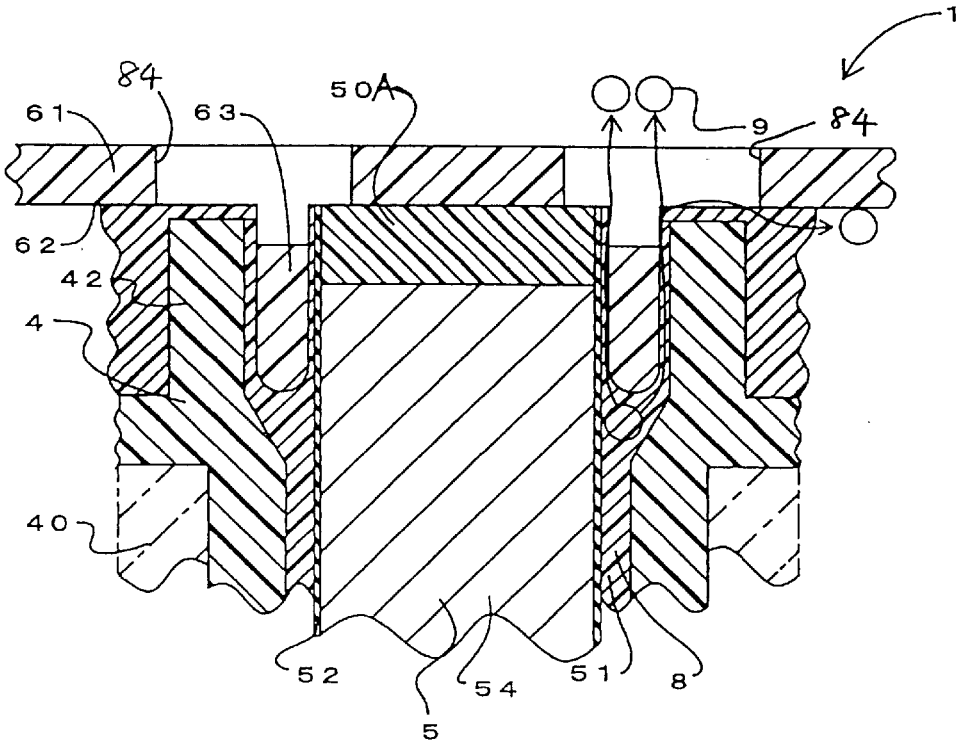
FIG. 16 is a longitudinal section view of a locating member and its neighborhood in an ignition coil according to a tenth embodiment of this invention.
Figure 17:
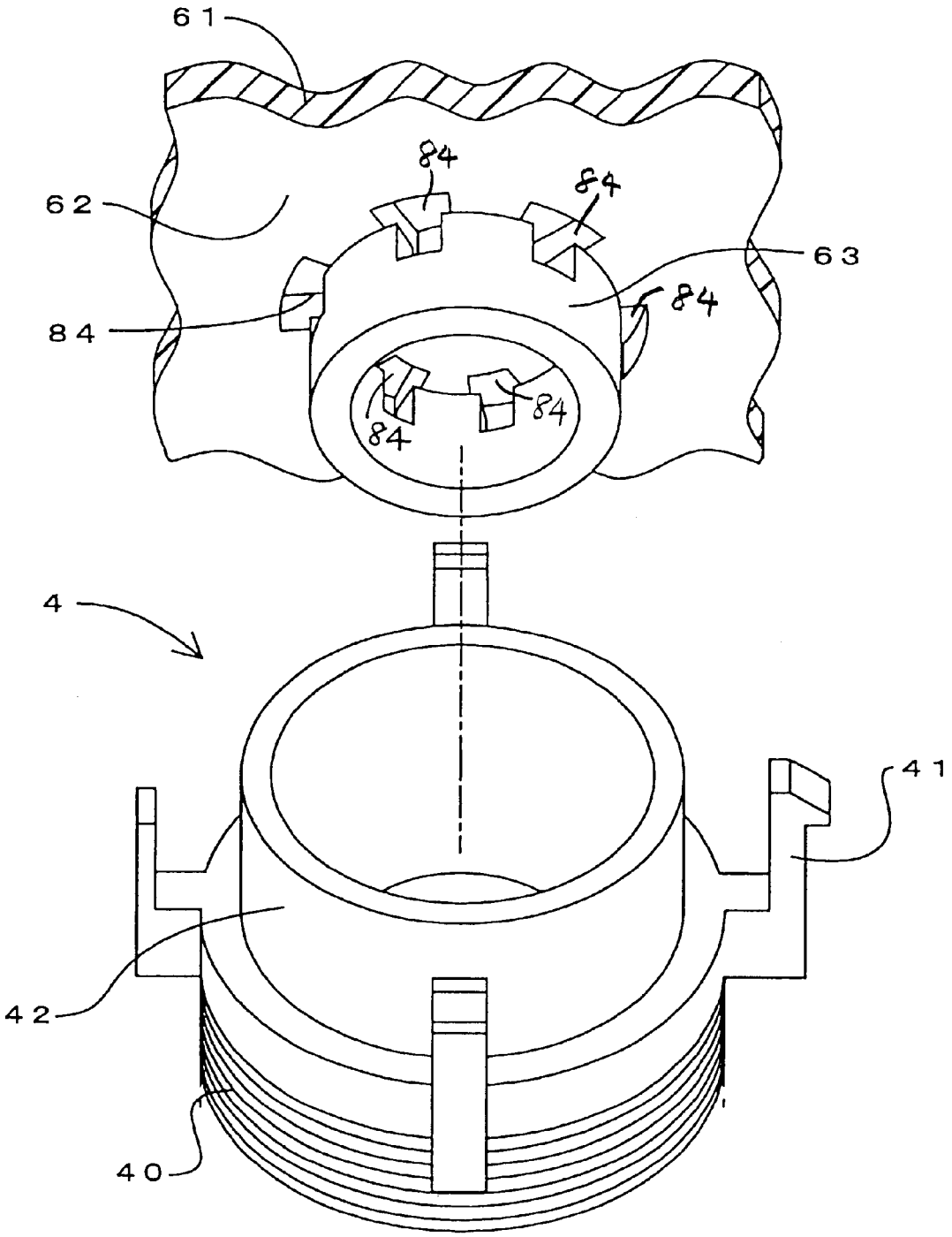
FIG. 17 is an exploded perspective view of the locating member and an upper portion of a secondary spool in the ignition coil of the tenth embodiment of this invention.

FIG. 16 shows a locating member 61 and its neighborhood in the tenth embodiment of this invention. FIG. 17 shows the locating member 61 and an upper end 42 of a secondary spool 4 in the tenth embodiment of this invention.

As shown in FIGS. 16 and 17, the locating member 61 has six void-escape holes (void-escape rib holes) 84 extending through the wall thereof. Each of the void-escape holes 84 extends through the side wall forming a base portion of the locating rib 63. The void-escape holes 84 are spaced at 60° intervals in the circumferential direction with respect to the locating rib 63. The void-escape holes 84 extend radially. Outer ends of the void-escape holes 84 are located directly above the outside of the secondary spool 4. Thus, the void-escape holes 84 lead to the outside of the secondary spool 4. There is a clearance between the outer circumferential surface of the locating rib 63 and the inner circumferential surface of the upper end 42 of the secondary spool 4. Also, there is a clearance between the outer circumferential surface of the rubber tube 52 of the central core portion 5 and the inner circumferential surface of the locating rib 63. The void-escape holes 84 communicate with the gap 51 between the central core portion 5 and the secondary spool 4 via the above-indicated clearances.

As shown in FIG. 16, a void 9 moves upward from injected epoxy prepolymer and curing agent in the gap 51 to one of the void-escape holes 84 via the above-indicated clearances. Then, the void 9 passes through the void-escape hole 84 before reaching the outside (the upper side) of the locating member 1. Since the void-escape hole 84 extends radially, the void 9 can move to the outside of the secondary spool 4 via the void-escape hole 84.

One void 9 can escape from injected epoxy prepolymer and curing agent toward the exterior via one or more of plural paths including the void-escape holes 84. Accordingly, it is easy for a void or voids to escape from injected epoxy prepolymer and curing agent.

Eleventh Embodiment

An eleventh embodiment of this invention is similar to the tenth embodiment thereof except for a design change mentioned hereafter.

Figure 18:
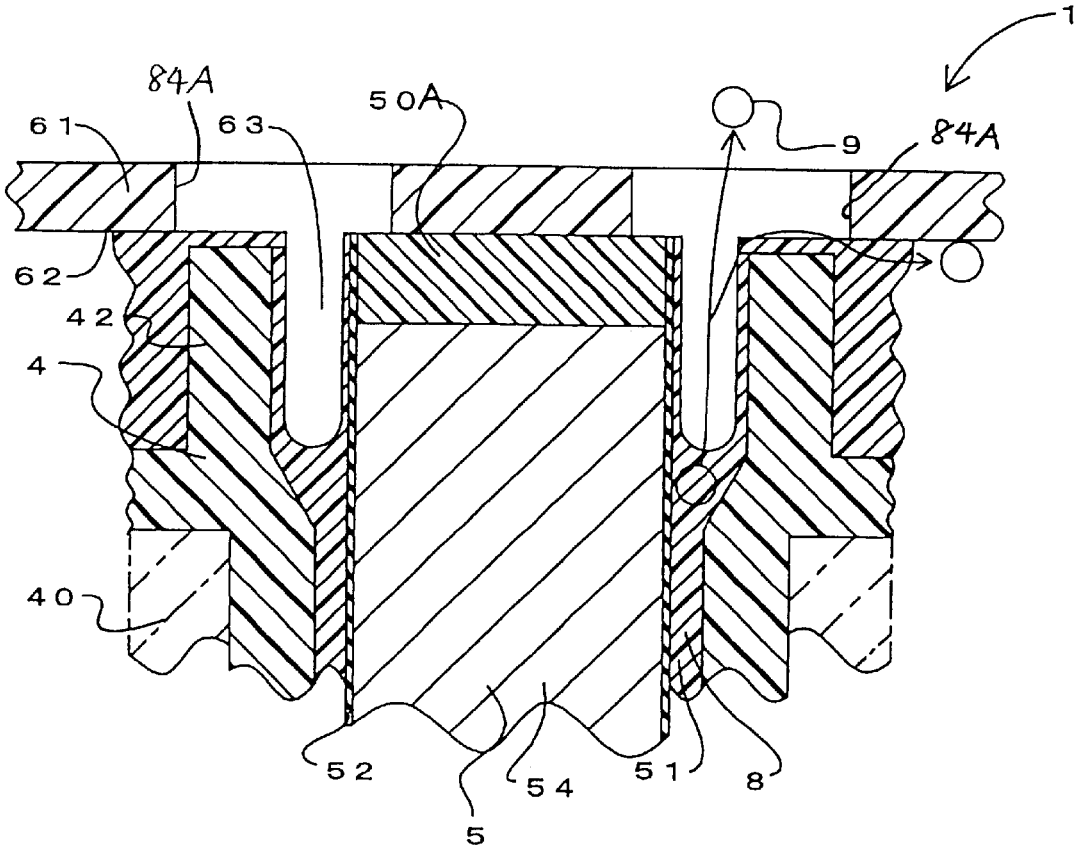
FIG. 18 is a longitudinal section view of a locating member and its neighborhood in an ignition coil according to an eleventh embodiment of this invention.
Figure 19:
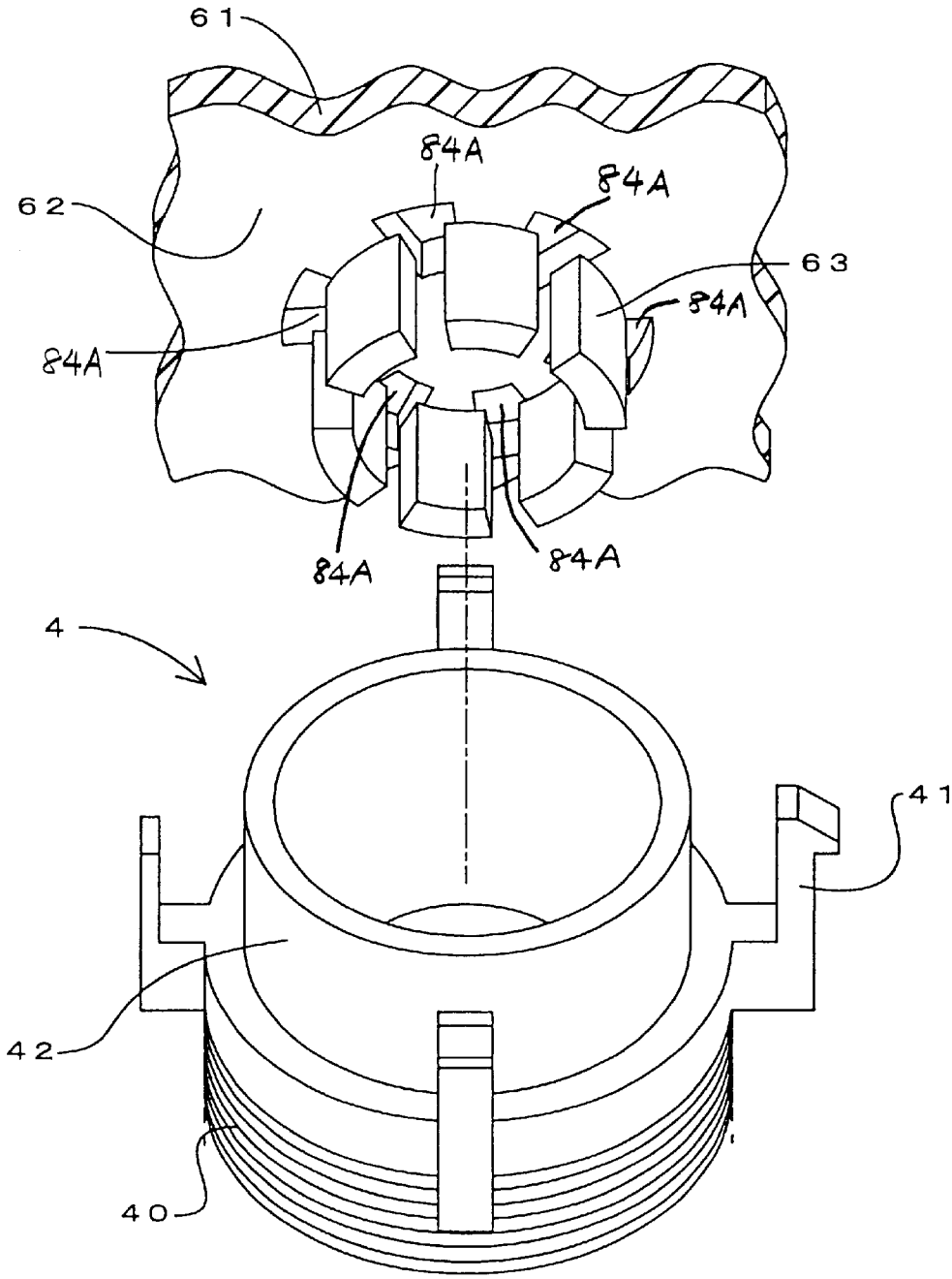
FIG. 19 is an exploded perspective view of the locating member and an upper portion of a secondary spool in the ignition coil of the eleventh embodiment of this invention.

FIG. 18 shows a locating member 61 and its neighborhood in the eleventh embodiment of this invention. FIG. 19 shows the locating member 61 and an upper end 42 of a secondary spool 4 in the eleventh embodiment of this invention.

As shown in FIGS. 18 and 19, the locating member 61 has six void-escape holes (void-escape rib holes) 84A extending through the wall thereof. Each of the void-escape holes 84A extends through the side wall of the locating rib 63. The void-escape holes 84A are spaced at 60° intervals in the circumferential direction with respect to the locating rib 63. The locating rib 63 is divided into six segments separated by the void-escape holes 84A. The void-escape holes 84A extend radially. Outer ends of the void-escape holes 84A are located directly above the outside of the secondary spool 4. Thus, the void-escape holes 84A lead to the outside of the secondary spool 4. The void-escape holes 84A communicate with the gap 51 between the central core portion 5 and the secondary spool 4.

As shown in FIG. 18, a void 9 moves upward from injected epoxy prepolymer and curing agent in the gap 51 to the outside of the locating member 61 via one of the void-escape holes 84A. Since the void-escape hole 84A extends radially, the void 9 can move to the outside of the secondary spool 4 via the void-escape hole 84A.

The void-escape holes 84A provide a relatively great effective cross-sectional area of a path for the escape of voids. Accordingly, it is easy for a void or voids to escape from injected epoxy prepolymer and curing agent in the gap 51.

Twelfth Embodiment

A twelfth embodiment of this invention is similar to the eleventh embodiment thereof except for a design change mentioned hereafter.

Figure 20:
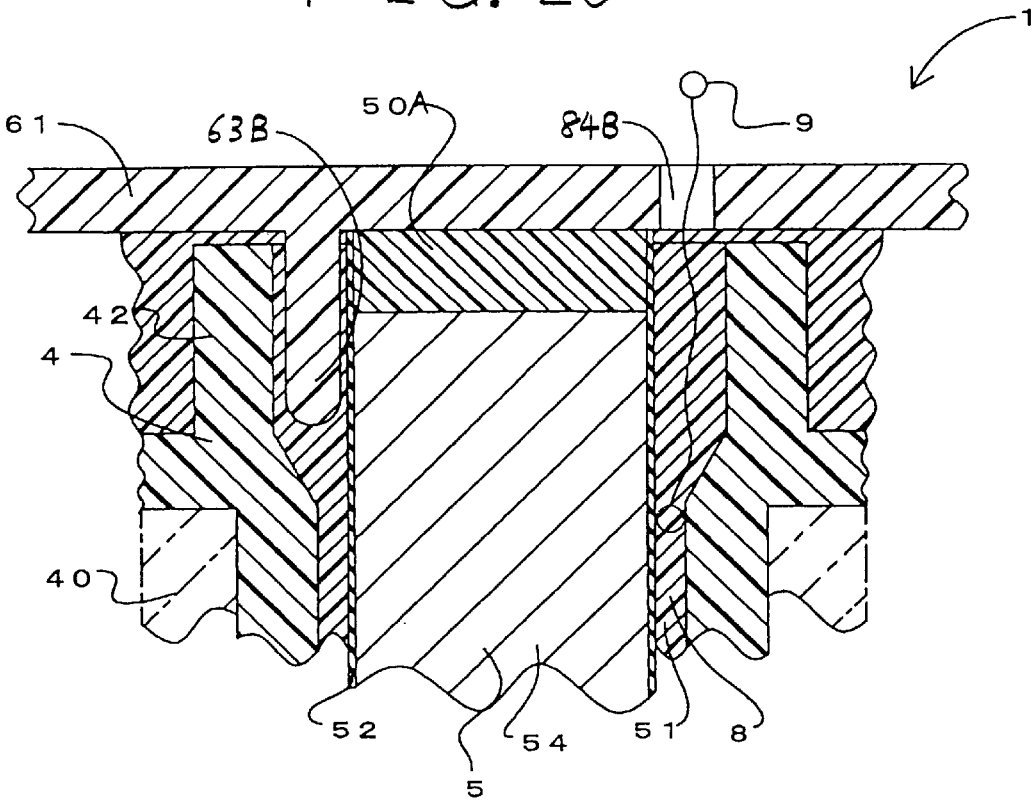
FIG. 20 is a longitudinal section view of a locating member and its neighborhood in an ignition coil according to a twelfth embodiment of this invention.
Figure 21:
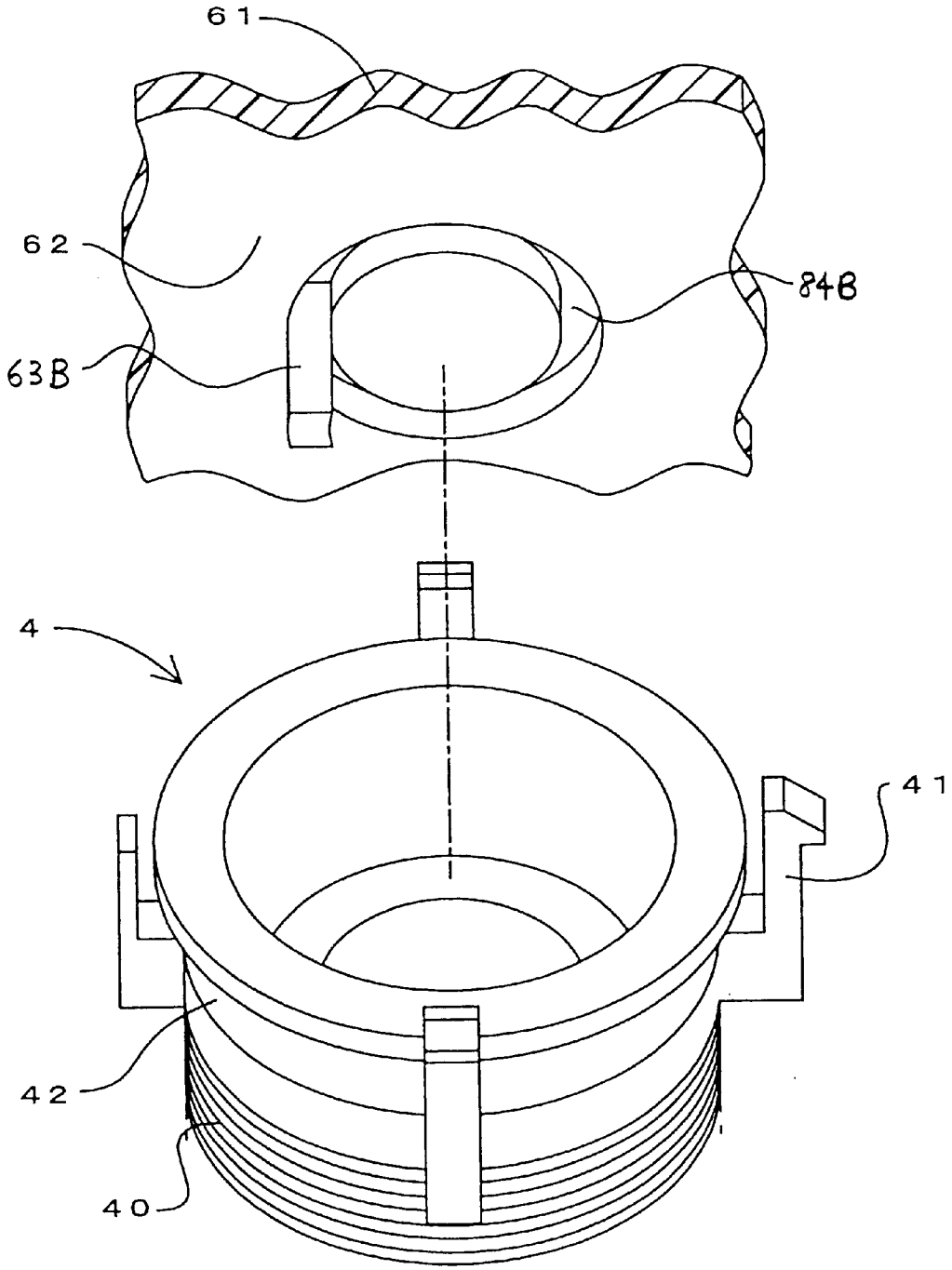
FIG. 21 is an exploded perspective view of the locating member and an upper portion of a secondary spool in the ignition coil of the twelfth embodiment of this invention.

FIG. 20 shows a locating member 61 and its neighborhood in the twelfth embodiment of this invention. FIG. 21 shows the locating member 61 and an upper end 42 of a secondary spool 4 in the twelfth embodiment of this invention.

As shown in FIGS. 20 and 21, a locating rib 63B extends downward from the lower end surface 62 of the locating member 61. The locating rib 63B replaces the locating rib 63 (see FIGS. 18 and 19). The locating rib 63B is in the shape of a prism rather than a ring.

The locating member 61 has a C-shaped void-escape hole (a C-shaped void-escape rib hole) 84B extending through the wall thereof. The edges of the C shape of the void-escape hole 84B are defined by the locating rib 63B. The void-escape hole 84B substantially axially aligns with the gap 51 between the central core portion 5 and the secondary spool 4. Thus, the void-escape hole 84B communicates with the gap 51.

As shown in FIG. 20, a void 9 moves upward from injected epoxy prepolymer and curing agent in the gap 51 to the outside of the locating member 61 via the void-escape hole 84B. The void escape hole 84B has the C shape. Therefore, even when there are voids in the injected epoxy prepolymer and curing agent at different circumferential positions, the voids can quickly escape to the outside of the locating member 61 via the void-escape hole 84B.

Thirteenth Embodiment

A thirteenth embodiment of this invention is similar to the first embodiment thereof except that void-escape holes in a locating rib replace the spool-side void-escape slits 43 (see FIGS. 2 and 3).

Figure 22:
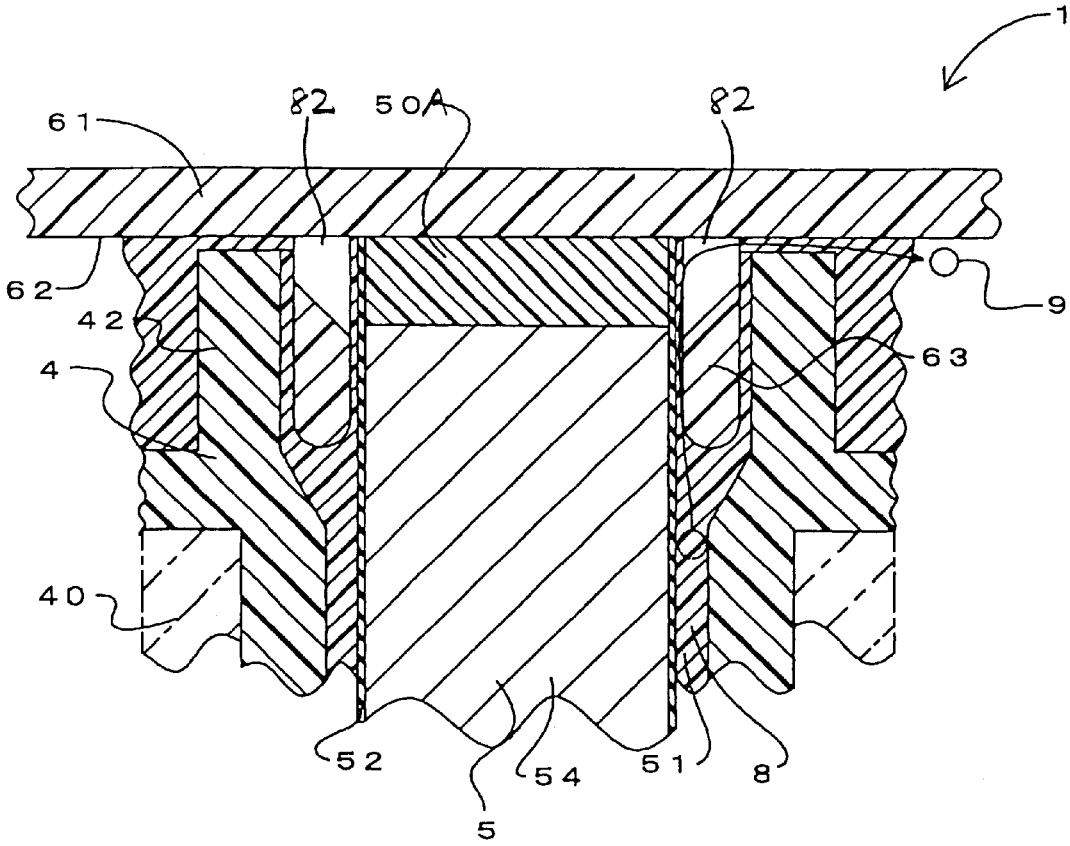
FIG. 22 is a longitudinal section view of a locating member and its neighborhood in an ignition coil according to a thirteenth embodiment of this invention.
Figure 23:
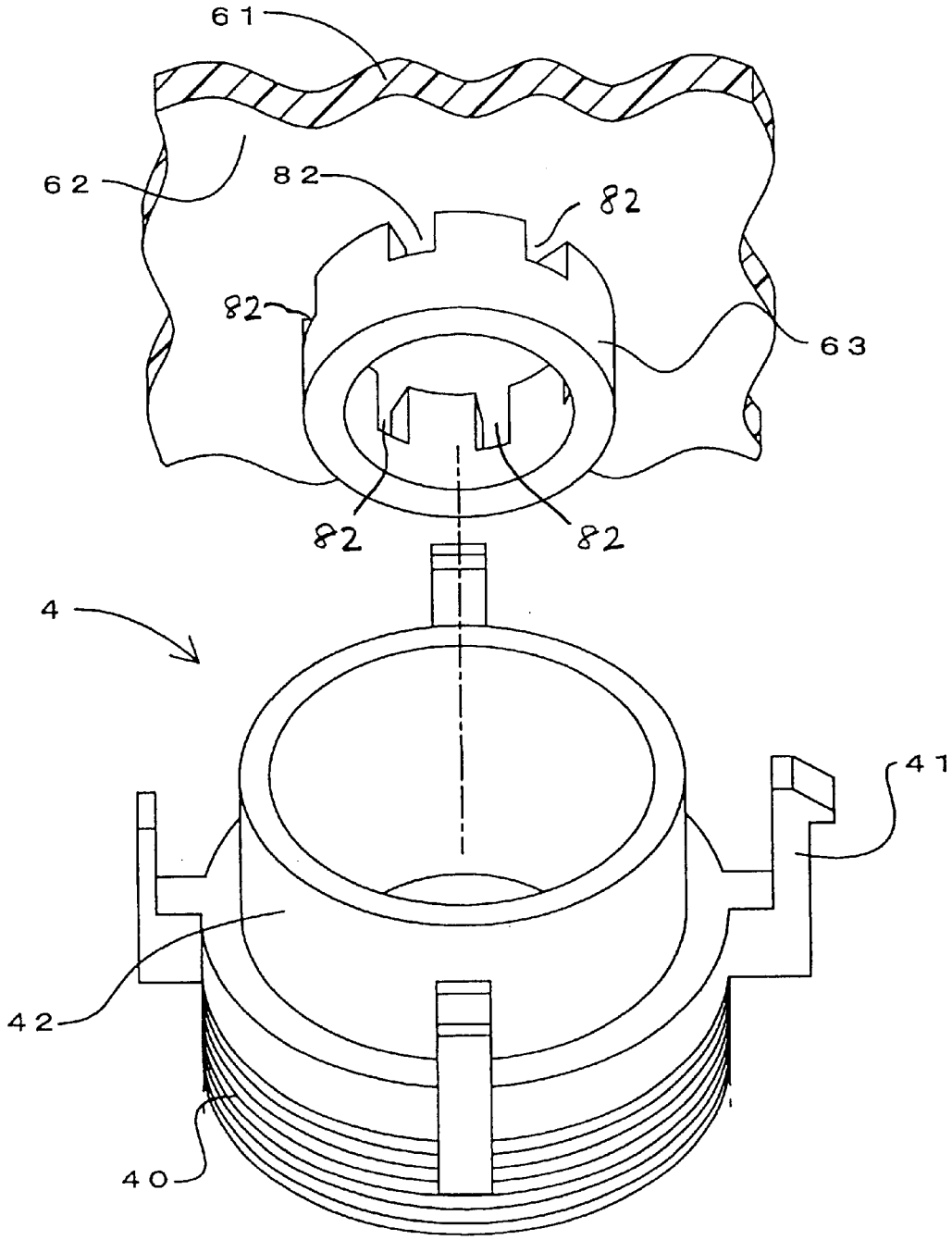
FIG. 23 is an exploded perspective view of the locating member and an upper portion of a secondary spool in the ignition coil of the thirteenth embodiment of this invention.

FIG. 22 shows a locating member 61 and its neighborhood in the thirteenth embodiment of this invention. FIG. 23 shows the locating member 61 and an upper end 42 of a secondary spool 4 in the thirteenth embodiment of this invention.

As shown in FIGS. 22 and 23, a base portion of a locating rib 63 has six void-escape taper holes (void-escape rib holes) 82 extending through the side wall thereof. The void-escape taper holes 82 are spaced at 60° intervals in the circumferential direction with respect to the locating rib 63. Each of the void-escape taper holes 82 extends between the inner circumferential surface and the outer circumferential surface of the locating rib 63.

As shown in FIG. 22, the surfaces of the locating rib 63 which define the lower ends of the void-escape taper holes 82 have upward slopes with respect to the radially outward directions. Thus, the inner-side openings (the inner-side inlets) of the void-escape taper holes 82 are elongated vertically or axially. There is a clearance between the outer circumferential surface of the rubber tube 52 of the central core portion 5 and the inner circumferential surface of the locating rib 63. The void-escape taper holes 82 communicate with the gap 51 between the central core portion 5 and the secondary spool 4 via the above-indicated clearance. There is a clearance between the lower end surface 62 of the locating member 61 and the top surface of the upper end 42 of the secondary spool 4. The void-escape taper holes 82 lead to the outside of the secondary spool 4 via the above-indicated clearance.

As shown in FIG. 22, a void 9 moves upward from injected epoxy prepolymer and curing agent in the gap 51 to one of the void-escape taper holes 82 via the clearance between the outer circumferential surface of the rubber tube 52 of the central core portion 5 and the inner circumferential surface of the locating rib 63. Then, the void 9 passes through the void-escape taper hole 82 before reaching the outside of the secondary spool 4 via the clearance between the lower end surface 62 of the locating member 61 and the top surface of the upper end 42 of the secondary spool 4.

A void or voids can easily escape from the clearance between the outer circumferential surface of the rubber tube 52 of the central core portion 5 and the inner circumferential surface of the locating rib 63 toward the exterior via the void-escape taper holes 82. As previously mentioned, the inner-side openings of the void-escape taper holes 82 are elongated vertically or axially. Therefore, even when there are voids in the injected epoxy prepolymer and curing agent at different vertical positions within the clearance between the outer circumferential surface of the rubber tube 52 of the central core portion 5 and the inner circumferential surface of the locating rib 63, the voids can quickly escape to the outside of the secondary spool 4.

Fourteenth Embodiment

A fourteenth embodiment of this invention is similar to the first embodiment thereof except that a void-escape annular passage replaces the spool-side void-escape slits 43 (see FIGS. 2 and 3).

Figure 24:
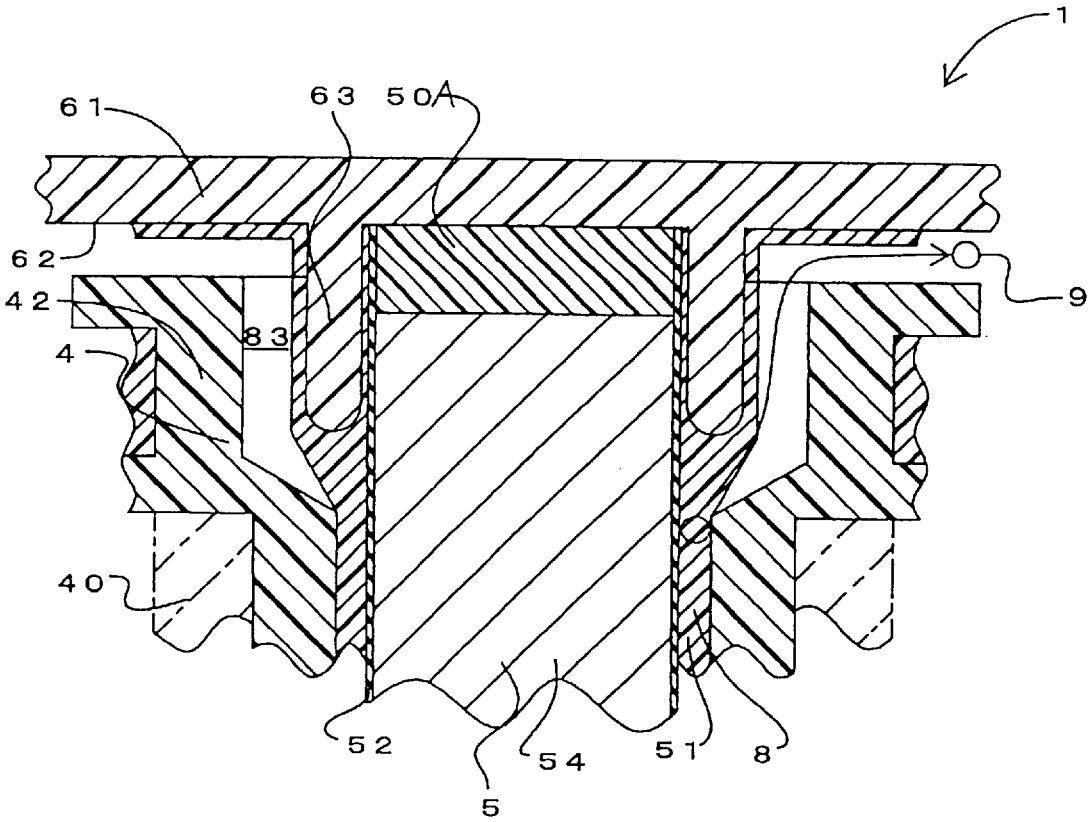
FIG. 24 is a longitudinal section view of a locating member and its neighborhood in an ignition coil according to a fourteenth embodiment of this invention.
Figure 25:
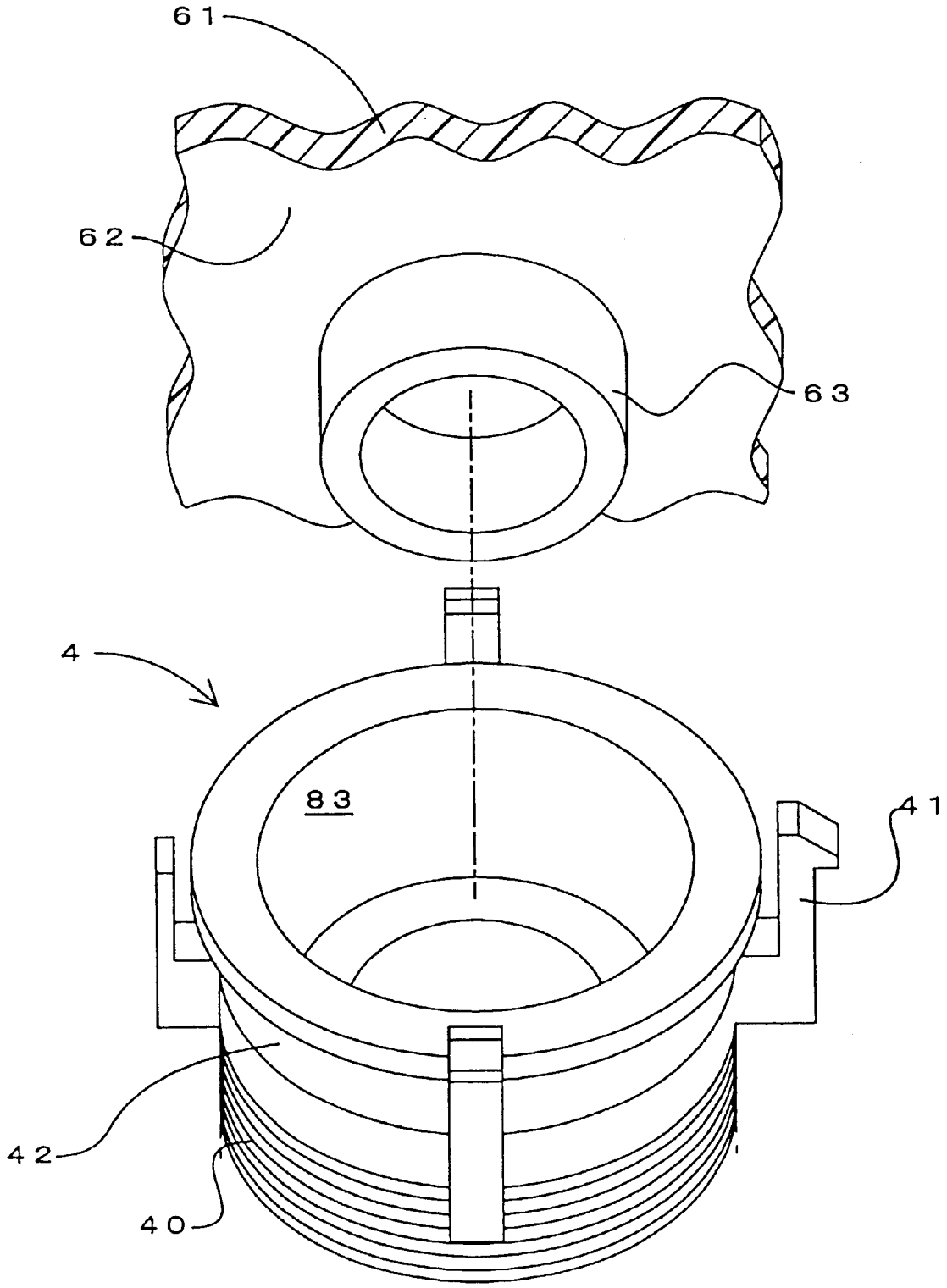
FIG. 25 is an exploded perspective view of the locating member and an upper portion of a secondary spool in the ignition coil of the fourteenth embodiment of this invention.

FIG. 24 shows a locating member 61 and its neighborhood in the fourteenth embodiment of this invention. FIG. 25 shows the locating member 61 and an upper end 42 of a secondary spool 4 in the fourteenth embodiment of this invention.

As shown in FIGS. 24 and 25, a void-escape annular passage 83 extends inward of the upper end 42 of the secondary spool 4. The void-escape annular passage 83 is in the shape of approximately a cylinder having a flange extending above the upper end 42 of the secondary spool 4. A part of the void-escape annular passage 83 is defined by the inner circumferential surface of the upper end 42 of the secondary spool 4. The void-escape annular passage 83 is one type of a spool-side void-escape recess. The void-escape annular passage 83 provides a widened gap portion between the outer circumferential surface of the locating rib 63 and the inner circumferential surface of the upper end 42 of the secondary spool 4. In addition, the void-escape annular passage 83 provides a widened gap portion between the lower end surface 62 of the locating member 61 and the top surface of the upper end 42 of the secondary spool 4. The void-escape annular passage 83 communicates with the gap 51 between the central core portion 5 and the secondary spool 4. Also, the void-escape annular passage 83 leads to the outside of the secondary spool 4.

As shown in FIG. 24, a void 9 enters the void-escape annular passage 83 from injected epoxy prepolymer and curing agent in the gap 51. Then, the void 9 moves upward in the cylindrical portion of the void-escape annular passage 83 before flowing radially outward along the flange portion of the void-escape annular passage 83 and reaching the outside of the secondary spool 4. Accordingly, the void 9 is prevented from remaining in the epoxy resin 8 after the cure occurs.

Fifteenth Embodiment

A fifteenth embodiment of this invention is similar to the fifth embodiment thereof except for design changes mentioned hereafter. In the fifteenth embodiment of this invention, the spool-side void-escape recesses 80 (see FIGS. 9 and 10) are absent from the secondary spool 4.

Figure 26:
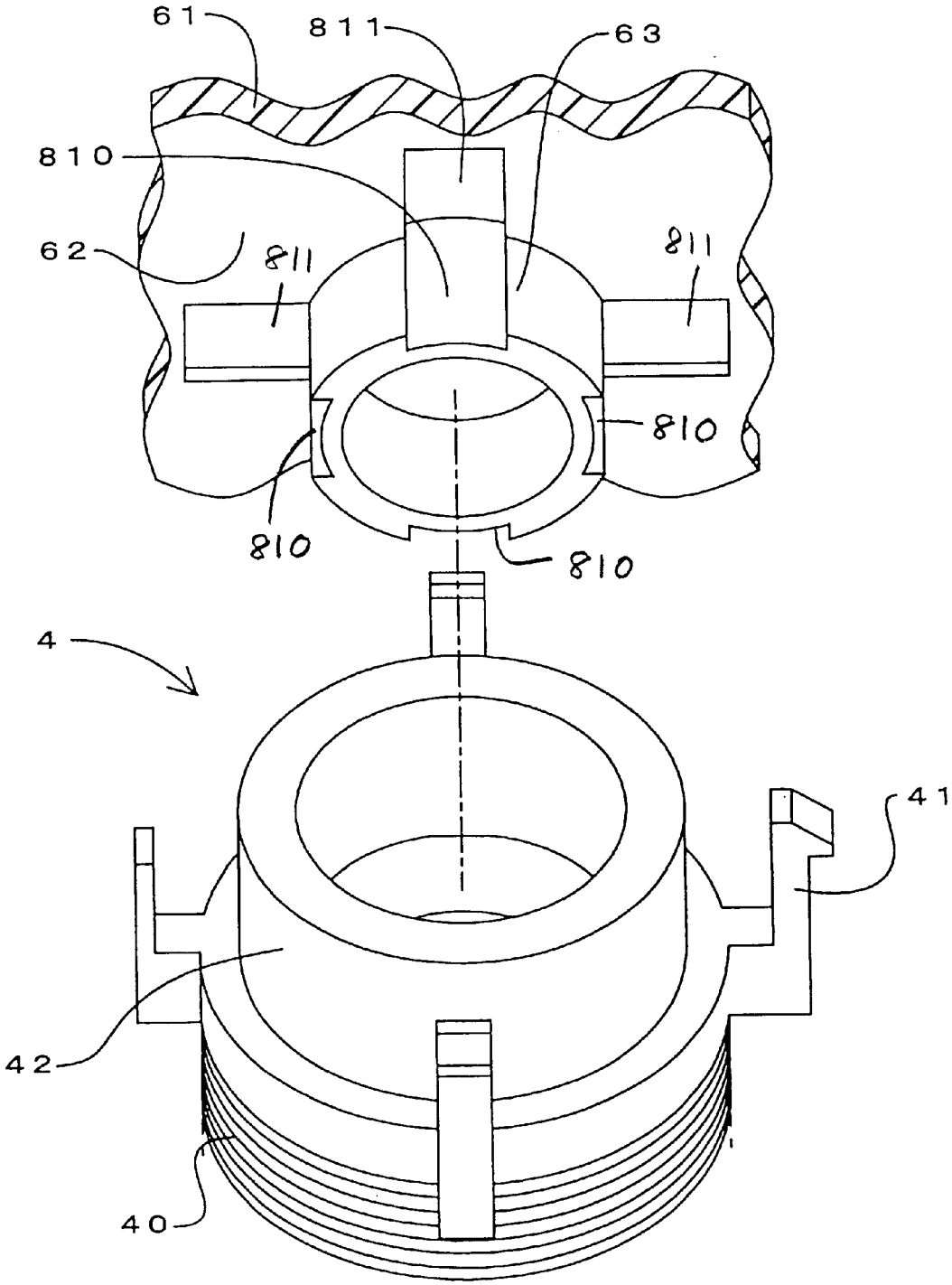
FIG. 26 is an exploded perspective view of a locating member and an upper portion of a secondary spool in an ignition coil according to a fifteenth embodiment of this invention.

FIG. 26 shows a locating member 61 and an upper portion of the secondary spool 4 in the fifteenth embodiment of this invention.

As shown in FIG. 26, four locating-member-side void-escape recesses (grooves) 810 are formed in the outer circumferential surface of the locating rib 63. Each of the locating-member-side void-escape recesses 810 has a shape of a groove extending vertically or axially. The locating-member-side void-escape recesses 810 are spaced at 90° intervals in the circumferential direction. The locating-member-side void-escape recesses 810 are in communication with the gap 51 (see FIG. 9) between the central core portion 5 and the secondary spool 4.

Four locating-member-side void-escape recesses (grooves) 811 are formed in the lower end surface 62 of the locating member 61 which extends outward of the locating rib 63. Each of the locating-member-side void-escape recesses 811 has a shape of a groove. The locating-member-side void-escape recesses 811 are spaced at 90° intervals in the circumferential direction. The locating-member-side void-escape recesses 811 extend radially from the locating-member-side void-escape recesses 810, respectively. Thus, the locating-member-side void-escape recesses 811 are connected to the locating-member-side void-escape recesses 810 at a base of the locating rib 63. The locating-member-side void-escape recesses 811 lead to the outside of the secondary spool 4.

A void enters one of the locating-member-side void-escape recesses 810 from injected epoxy prepolymer and curing agent in the gap 51 (see FIG. 9). Then, the void moves upward in the locating-member-side void-escape recess 810, and reaches the related locating-member-side void-escape recess 811. The void moves radially outward along the locating-member-side void-escape recess 811 before reaching the outside of the secondary spool 4. Accordingly, the void is prevented from remaining in the epoxy resin 8 (see FIG. 9) after the cure occurs.

Sixteenth Embodiment

A sixteenth embodiment of this invention is similar to the fourteenth embodiment thereof except that spool-side void-escape recesses replace the void-escape annular passage 83 (see FIGS. 24 and 25).

Figure 27:
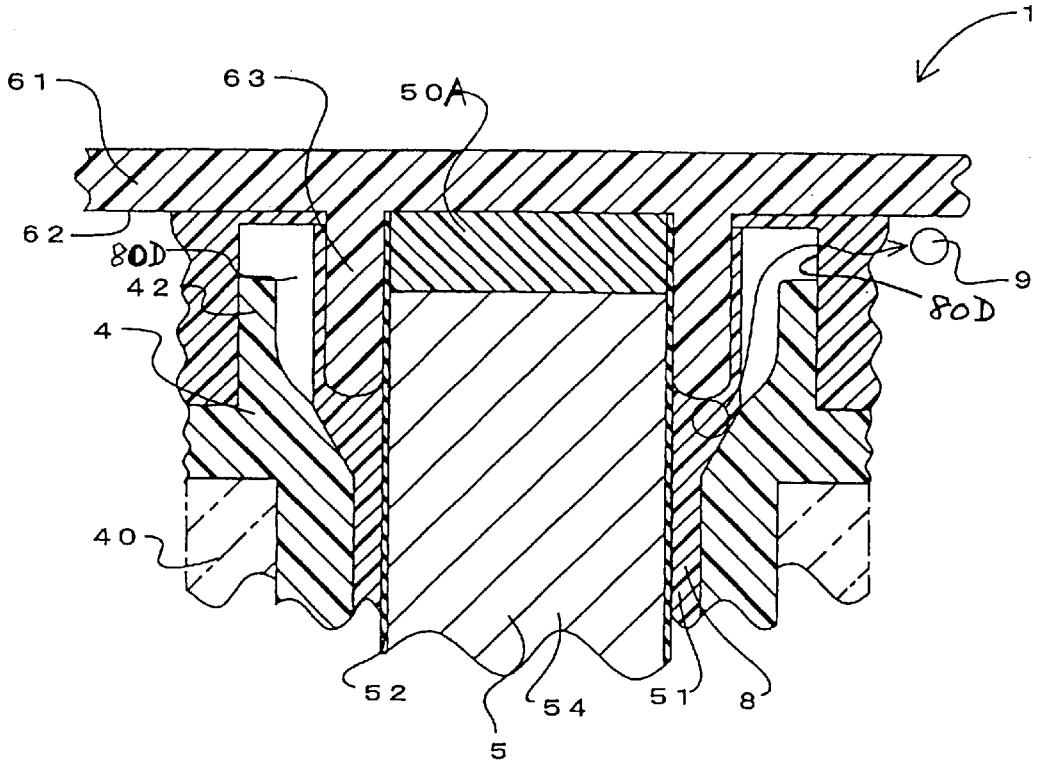
FIG. 27 is a longitudinal section view of a locating member and its neighborhood in an ignition coil according to a sixteenth embodiment of this invention.
Figure 28:
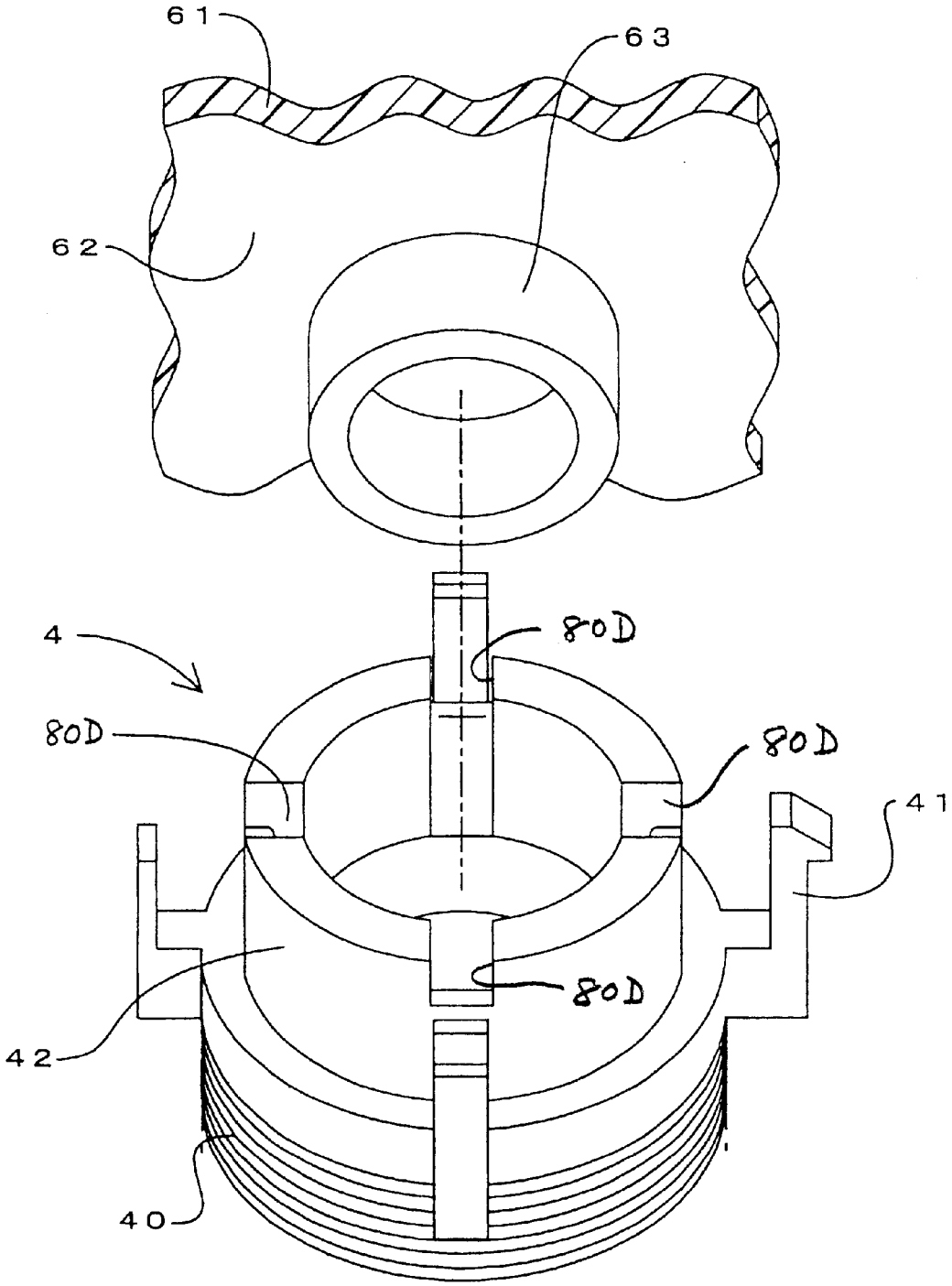
FIG. 28 is an exploded perspective view of the locating member and an upper portion of a secondary spool in the ignition coil of the sixteenth embodiment of this invention.

FIG. 27 shows a locating member 61 and its neighborhood in the sixteenth embodiment of this invention. FIG. 28 shows the locating member 61 and an upper end 42 of a secondary spool 4 in the sixteenth embodiment of this invention.

As shown in FIGS. 27 and 28, four spool-side void-escape recesses (grooves) 80D are formed in the inner circumferential surface and the top surface of the upper portion 42 of the secondary spool 4. Each of the spool-side void-escape recesses 80D is in the shape of a groove having a vertically-extending portion (an axially-extending portion) and an upper portion extending radially outward from a top of the vertically-extending portion. The vertically-extending portion of each of the spool-side void-escape recesses 80D communicates with the gap 51 between the central core portion 5 and the secondary spool 4. The upper portion of each of the spool-side void-escape recesses 80D leads to the outside of the secondary spool 4. The spool-side void-escape recesses 80D are spaced at 90° intervals in the circumferential direction. The spool-side void-escape recesses 80D provide widened gap portions between the outer circumferential surface of the locating rib 63 and the inner circumferential surface of the upper end 42 of the secondary spool 4. In addition, the spool-side void-escape recesses 80D provide widened gap portions between the lower end surface 62 of the locating member 61 and the top surface of the upper end 42 of the secondary spool 4.

As shown in FIG. 27, a void 9 enters one of the spool-side void-escape recesses 80D from injected epoxy prepolymer and curing agent in the gap 51. Then, the void 9 moves upward in the vertically-extending portion of the spool-side void-escape recess 80D before flowing radially outward along the upper portion of the spool-side void-escape recess 80D and reaching the outside of the secondary spool 4. Accordingly, the void 9 is prevented from remaining in the epoxy resin 8 after the cure occurs.

Seventeenth Embodiment

A seventeenth embodiment of this invention is similar to the eleventh embodiment thereof except that void-escape rib holes and locating-member-side void-escape recesses replace the void-escape rib holes 84A (see FIGS. 18 and 19).

Figure 29:
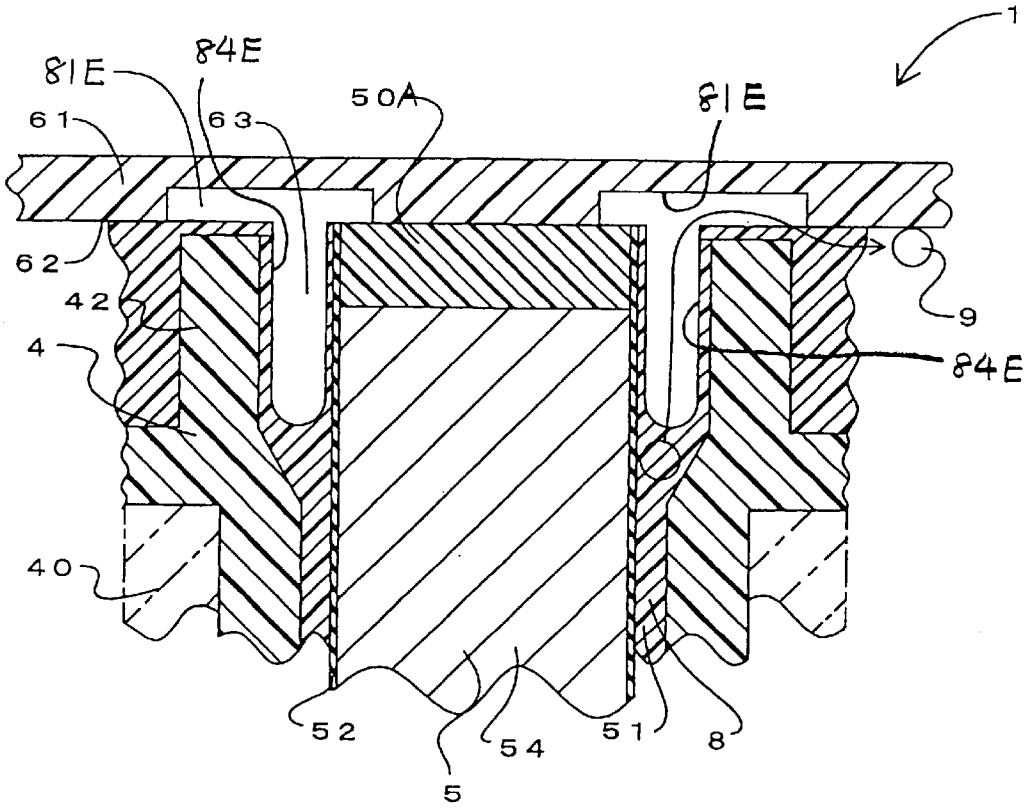
FIG. 29 is a longitudinal section view of a locating member and its neighborhood in an ignition coil according to a seventeenth embodiment of this invention.

FIG. 29 shows a locating member 61 and its neighborhood in the seventeenth embodiment of this invention. As shown in FIG. 29, the locating rib 63 has void-escape holes (void-escape rib holes) 84E extending through the side wall thereof. The void-escape holes 84E are spaced at 60° intervals in the circumferential direction with respect to the locating rib 63. The locating rib 63 is divided into six vertically-extending segments (six axially-extending segments) separated by the void-escape holes 84E. The void-escape holes 84E communicate with the gap 51 between the central core portion 5 and the secondary spool 4.

Six locating-member-side void-escape recesses (grooves) 81E are formed in the lower end surface 62 of the locating member 61 which extends at and around a base of the locating rib 63. The locating-member-side void-escape recesses 81E extend radially. The locating-member-side void-escape recesses 81E lead to the outside of the secondary spool 4. The locating-member-side void-escape recesses 81E are spaced at 60° intervals in the circumferential direction. Inner portions of the locating-member-side void-escape recesses 81E axially align with the void-escape holes 84E, respectively. Thus, the locating-member-side void-escape recesses 81E communicate with the void-escape holes 84E respectively.

As shown in FIG. 29, a void 9 enters one of the void-escape holes 84E from injected epoxy prepolymer and curing agent in the gap 51. Then, the void 9 moves upward in the void-escape hole 84E before flowing radially outward along the related locating-member-side void-escape recess 81E and reaching the outside of the secondary spool 4. Accordingly, the void 9 is prevented from remaining in the epoxy resin 8 after the cure occurs.

Eighteenth Embodiment

An eighteenth embodiment of this invention is similar to the thirteenth embodiment thereof except for design changes mentioned hereafter.

Figure 30:
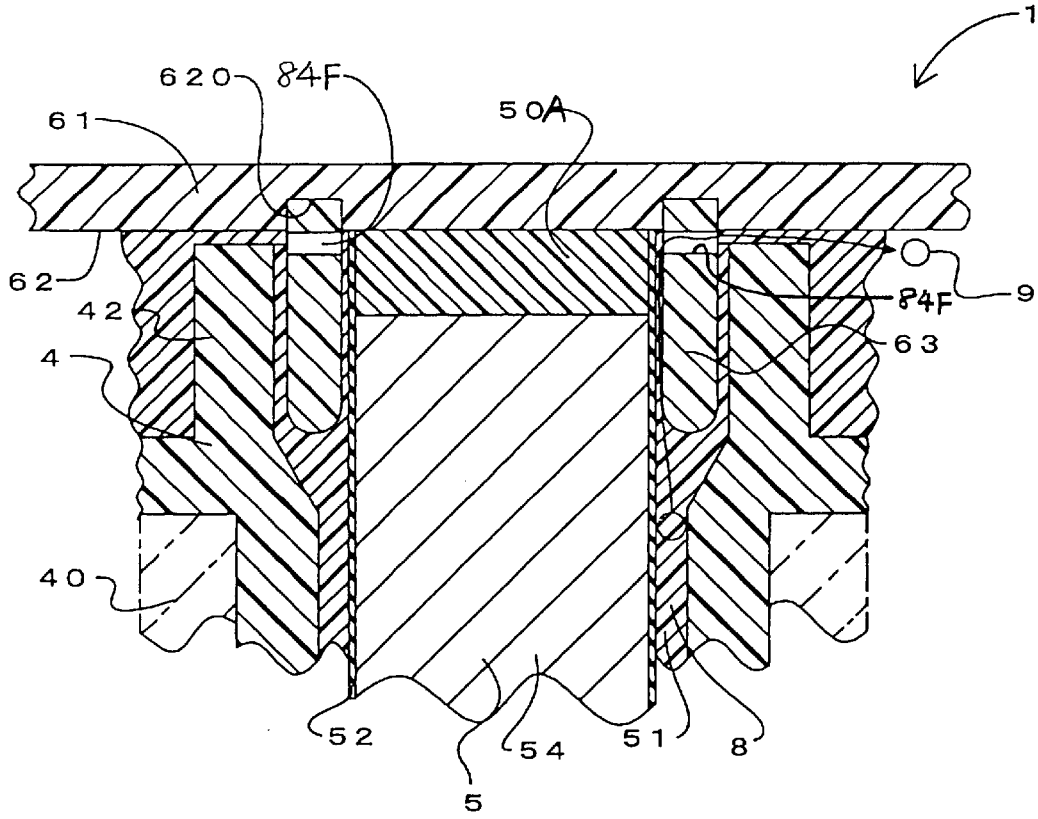
FIG. 30 is a longitudinal section view of a locating member and its neighborhood in an ignition coil according to an eighteenth embodiment of this invention.
Figure 31:
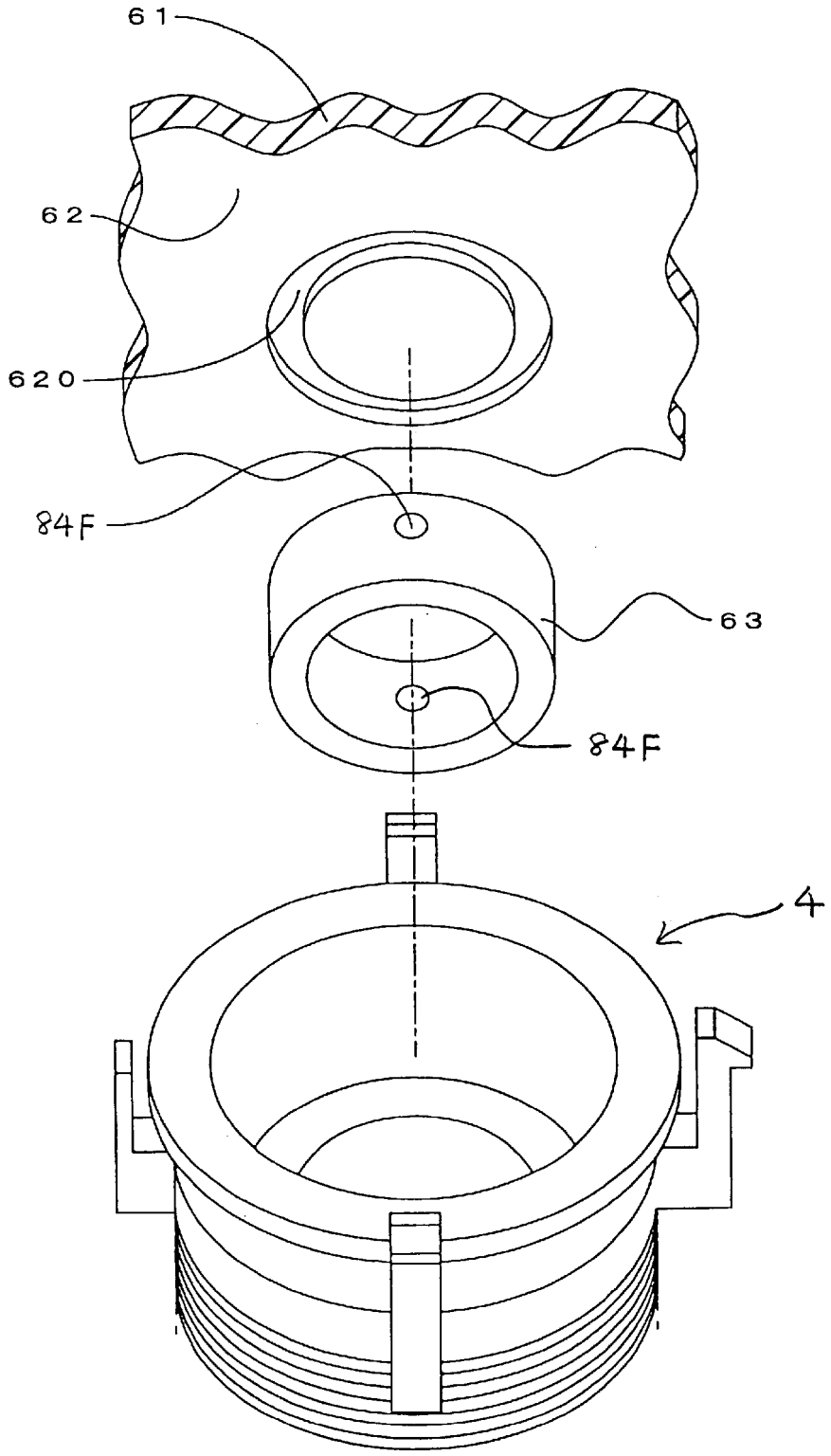
FIG. 31 is an exploded perspective view of the locating member and an upper portion of a secondary spool in the ignition coil of the eighteenth embodiment of this invention.

FIG. 30 shows a locating member 61 and its neighborhood in the eighteenth embodiment of this invention. FIG. 31 shows the locating member 61 and an upper end 42 of a secondary spool 4 in the eighteenth embodiment of this invention.

In the eighteenth embodiment of this invention, the locating member 61 and the locating rib 63 are separate. As shown in FIGS. 30 and 31, the lower end surface 62 of the locating member 61 has a ring groove 620 into which an upper end of the locating rib 63 fits.

The locating rib 63 has four void-escape holes (void-escape rib holes) 84F extending through the side wall thereof. The void-escape holes 84F replace the void-escape taper holes 82 (see FIGS. 22 and 23). The void-escape holes 84F extend radially and flat. The void-escape holes 84F are spaced at 90° intervals in the circumferential direction with respect to the locating rib 63.

As shown in FIG. 30, a void 9 moves upward from injected epoxy prepolymer and curing agent in the gap 51 to one of the void-escape holes 84F via the clearance between the outer circumferential surface of the rubber tube 52 of the central core portion 5 and the inner circumferential surface of the locating rib 63. Then, the void 9 flows radially outward along the void-escape hole 84F before reaching the outside of the secondary spool 4 via the clearance between the lower end surface 62 of the locating member 61 and the top surface of the upper end 42 of the secondary spool 4. Accordingly, the void 9 is prevented from remaining in the epoxy resin 8 after the cure occurs.

Preferably, the void-escape holes 84F are formed in the locating rib 63 before the locating rib 63 is fitted into the ring groove 620 in the locating member 61. Therefore, it is relatively easy to make the void-escape holes 84F.

Nineteenth Embodiment

A nineteenth embodiment of this invention is similar to the eighteenth embodiment thereof except for design changes mentioned hereafter.

Figure 32:
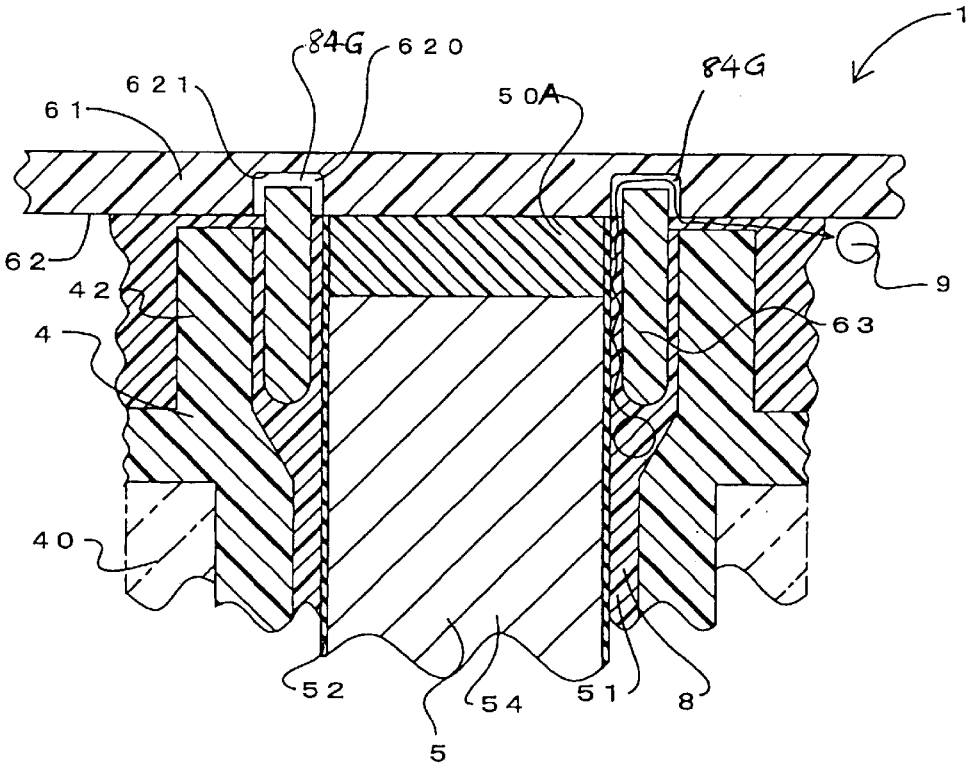
FIG. 32 is a longitudinal section view of a locating member and its neighborhood in an ignition coil according to a nineteenth embodiment of this invention.
Figure 33:
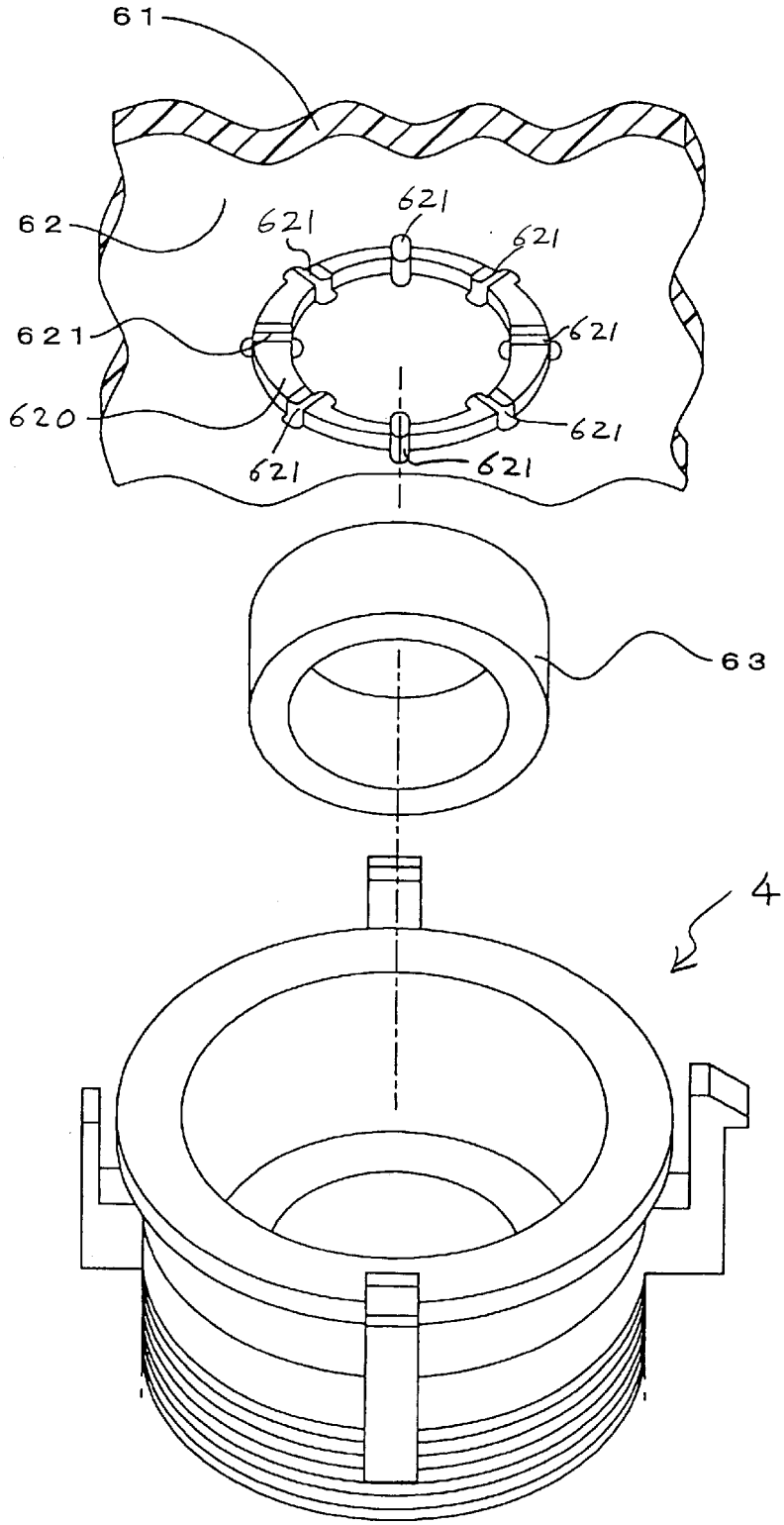
FIG. 33 is an exploded perspective view of the locating member and an upper portion of a secondary spool in the ignition coil of the nineteenth embodiment of this invention.

FIG. 32 shows a locating member 61 and its neighborhood in the nineteenth embodiment of this invention. FIG. 33 shows the locating member 61 and an upper end 42 of a secondary spool 4 in the nineteenth embodiment of this invention.

As shown in FIGS. 32 and 33, a ring groove 620 in the lower end surface 62 of the locating member 61 has eight enlarged portions 621. The enlarged portions 621 of the ring groove 620 are deeper than the other portions thereof. The enlarged portions 621 are elongated in radial directions. The enlarged portions 621 are spaced at 45° intervals in the circumferential direction with respect to the ring groove 620.

An upper end of the locating rib 63 fits into the ring groove 620. The enlarged portions 621 of the ring groove 620 cause void-escape holes (void-escape rib holes) 84G respectively which are defined between the top surface of the locating rib 63 and the downwardly-facing surfaces of the locating member 61. The void-escape holes 84G replace the void-escape holes 84F (see FIGS. 30 and 31).

The void-escape holes 84G are formed when the upper end of the locating rib 63 is fitted into the ring groove 620. Therefore, it is easy to make the void-escape holes 84G.

Twentieth Embodiment

A twentieth embodiment of this invention is similar to the nineteenth embodiment thereof except for a design change mentioned hereafter.

Figure 34:
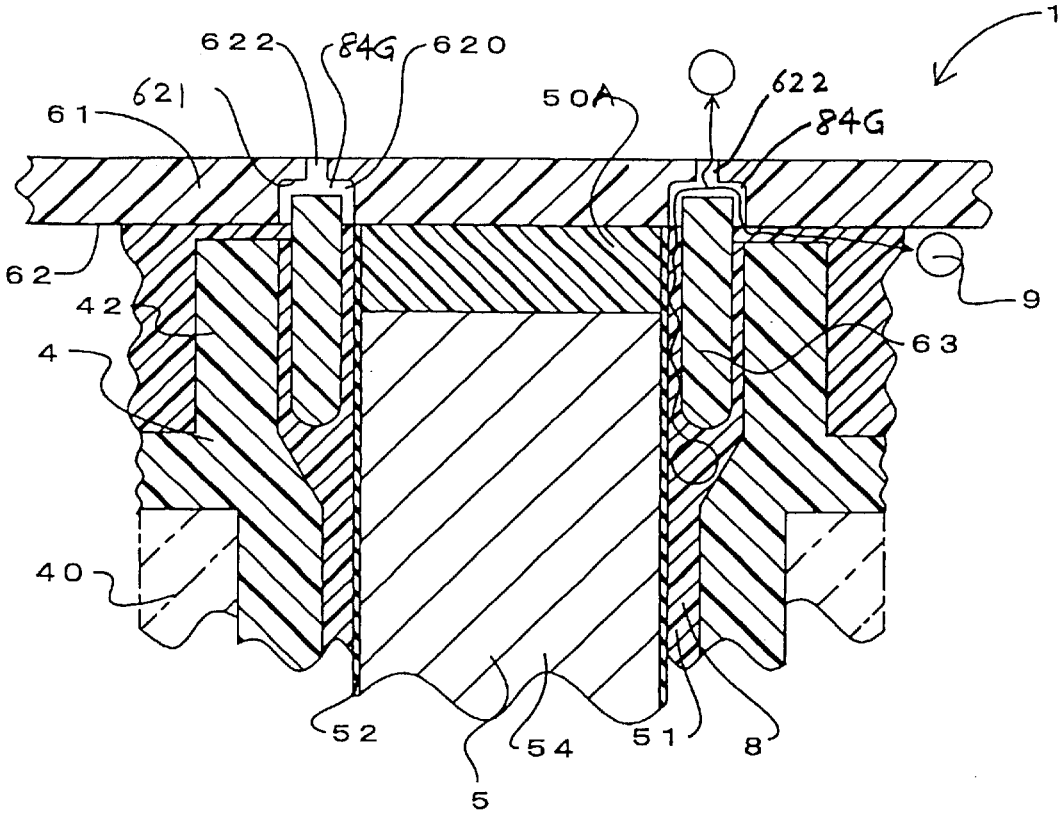
FIG. 34 is a longitudinal section view of a locating member and its neighborhood in an ignition coil according to a twentieth embodiment of this invention.

FIG. 34 shows a locating member 61 and its neighborhood in the twentieth embodiment of this invention. As shown in FIG. 34, the locating member 61 has groove bottom holes 622 extending through the wall thereof which defines the enlarged portions 621 of the ring groove 620. The groove bottom holes 622 provides communication of the void-escape holes 84G with the upper side (the outside) of the locating member 61.

As shown in FIG. 34, a void 9 moves upward from injected epoxy prepolymer and curing agent in the gap 51 to one of the void-escape holes 84G via the clearance between the outer circumferential surface of the rubber tube 52 of the central core portion 5 and the inner circumferential surface of the locating rib 63. Then, the void 9 flows radially outward along the void-escape hole 84G before reaching the outside of the secondary spool 4 via the clearance between the lower end surface 62 of the locating member 61 and the top surface of the upper end 42 of the secondary spool 4. In addition, the void 9 can flow from the void-escape hole 84G into the upper side of the locating member 61 via the related groove bottom hole 622. Accordingly, the void 9 is prevented from remaining in the epoxy resin 8 after the cure occurs.

Twenty-First Embodiment

A twenty-first embodiment of this invention is similar to the first embodiment thereof except for design changes mentioned hereafter.

Figure 35:
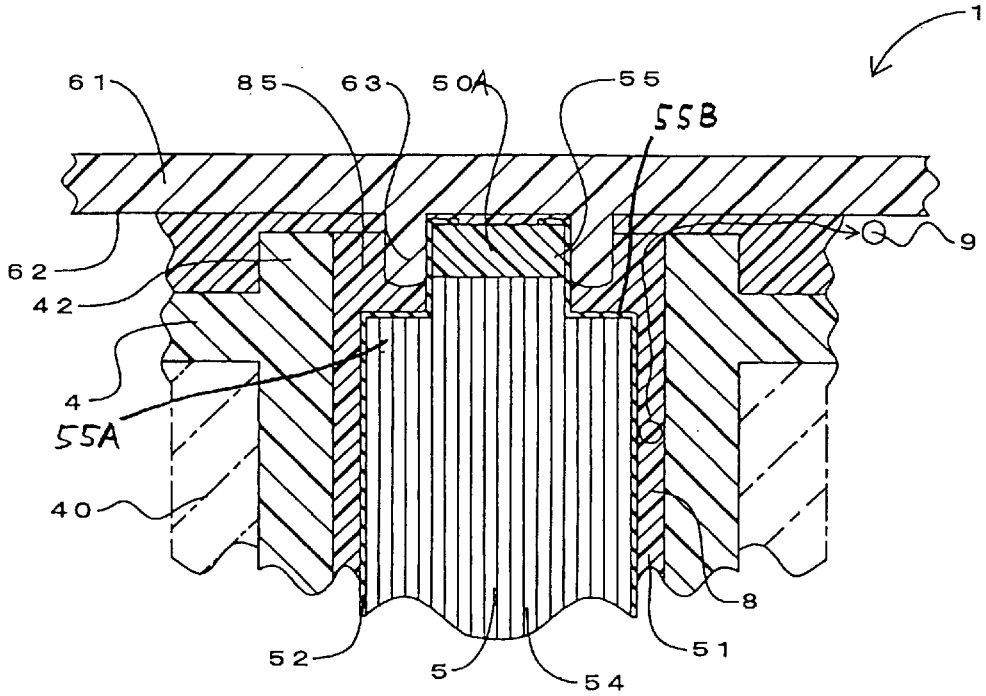
FIG. 35 is a longitudinal section view of a locating member and its neighborhood in an ignition coil according to a twenty-first embodiment of this invention.

FIG. 35 shows a locating member 61 and its neighborhood in the twenty-first embodiment of this invention. As shown in FIG. 35, an upper end of a central core portion 5 has a smaller-diameter part and a larger-diameter part 55A coaxial with each other. The upper end surface of the larger-diameter part 55A forms an annular shoulder 55B from which the smaller-diameter part 55 extends axially upward. The smaller-diameter part 55 has an outside diameter of about 1 mm. The locating rib 63 is located adjacently outward of the smaller-diameter part 55. The inside diameter of the locating rib 63 is equal to about 1 mm. The smaller-diameter part 55 is used for alignment. The radial dimension of the shoulder 55B is considerably greater than that of the side wall of the locating rib 63. A ring-shaped wide gap 85 is defined between the outer circumferential surface of the locating rib 63 and the inner circumferential surface of the upper end 42 of the secondary spool 4. The wide gap 85 communicates with the gap 51 between the central core portion 5 and the secondary spool 4. The wide gap 85 leads to the outside of the secondary spool 4 via a clearance between the top surface of the secondary spool 4 and the lower end surface 62 of the locating member 61.

As shown in FIG. 35, a void 9 moves from injected epoxy prepolymer and curing agent in the gap 51 to the outside of the secondary spool 4 via the wide gap 85 and the clearance between the top surface of the secondary spool 4 and the lower end surface 62 of the locating member 61. Accordingly, the void 9 is prevented from remaining in the epoxy resin 8 after the cure occurs.

Twenty-Second Embodiment

A twenty-second embodiment of this invention is similar to one of the first to twenty-first embodiments thereof except that the primary spool 3 is located inward of the secondary spool 4.

Twenty-Third Embodiment

A twenty-third embodiment of this invention is similar to one of the first to twenty-first embodiments thereof except for design changes mentioned hereafter. The numbers and positions of the spool-side void-escape slits 43, the spool-side void-escape holes 44, the auxiliary void-escape slits 67, the locating-member-side void-escape holes 68, the gaps 510, the spool-side void-escape recesses 80, the locating-member-side void-escape recesses 81, the spool-side void-escape recess 80A, the locating-member-side void-escape recess 81A, the spool-side void-escape holes 44, the spool-side void-escape recesses 80B, the spool-side void-escape recesses 80C, the void-escape rib holes 84, the void-escape rib holes 84A, the void-escape rib hole 84B, the void-escape rib holes 82, the void-escape annular passage 83, the locating-member-side void-escape recesses 810, the locating-member-side void-escape recesses 811, the spool-side void-escape recesses 80D, the locating-member-side void-escape recesses 81E, the void-escape holes 84E, the void-escape holes 84F, the void-escape holes 84G, and the wide gap 85 in the twenty-third embodiment of this invention are different from those in the first to twenty-first embodiments thereof.

In the case where many voids tend occur, the numbers of the spool-side void-escape slits 43, the spool-side void-escape holes 44, the auxiliary void-escape slits 67, the locating-member-side void-escape holes 68, the gaps 510, the spool-side void-escape recesses 80, the locating-member-side void-escape recesses 81, the spool-side void-escape recess 80A, the locating-member-side void-escape recess 81A, the spool-side void-escape holes 44, the spool-side void-escape recesses 80B, the spool-side void-escape recesses 80C, the void-escape rib holes 84, the void-escape rib holes 84A, the void-escape rib hole 84B, the void-escape rib holes 82, the void-escape annular passage 83, the locating-member-side void-escape recesses 810, the locating-member-side void-escape recesses 811, the spool-side void-escape recesses 80D, the locating-member-side void-escape recesses 81E, the void-escape holes 84E, the void-escape holes 84F, the void-escape holes 84G, and the wide gap 85 in the twenty-third embodiment of this invention are set greater than those in the first to twenty-first embodiments thereof.

The positions of the spool-side void-escape slits 43, the spool-side void-escape holes 44, the auxiliary void-escape slits 67, the locating-member-side void-escape holes 68, the gaps 510, the spool-side void-escape recesses 80, the locating-member-side void-escape recesses 81, the spool-side void-escape recess 80A, the locating-member-side void-escape recess 81A, the spool-side void-escape holes 44, the spool-side void-escape recesses 80B, the spool-side void-escape recesses 80C, the void-escape rib holes 84, the void-escape rib holes 84A, the void-escape rib hole 84B, the void-escape rib holes 82, the void-escape annular passage 83, the locating-member-side void-escape recesses 810, the locating-member-side void-escape recesses 811, the spool-side void-escape recesses 80D, the locating-member-side void-escape recesses 81E, the void-escape holes 84E, the void-escape holes 84F, the void-escape holes 84G, and the wide gap 85 in the twenty-third embodiment of this invention may be set depending on places where voids tend to occur.

Twenty-Fourth Embodiment

A twenty-fourth embodiment of this invention is similar to one of the first to twenty-first embodiments thereof except that the epoxy resin 8 is replaced by silicone resin or unsaturated polyester resin.

Twenty-Fifth Embodiment

A twenty-fifth embodiment of this invention is similar to one of the first to twenty-first embodiments thereof except that the locating member 61 and the body of the igniter 65 are separate. The locating member 61 and the body of the igniter 65 are joined together by, for example, a fusing treatment.

Twenty-Sixth Embodiment

A twenty-sixth embodiment of this invention is similar to the third embodiment thereof except for design changes mentioned hereafter. In the twenty-sixth embodiment of this invention, the number of auxiliary void-escape slits 67 in the locating rib 63 differs from three. The positions of the auxiliary void-escape slits 67 may be different from those in the third embodiment of this invention. Auxiliary void-escape holes may be provided which are similar to the spool-side void-escape holes 44 in the second embodiment of this invention.

Twenty-Seventh Embodiment

A twenty-seventh embodiment of this invention is similar to the fourth embodiment thereof except that the cross section of the central core portion 5 differs from an ellipse and a circle. The cross section of the central core portion 5 is designed so that a gap or gaps for guiding voids will be defined between the outer surface of the central core portion 5 and the inner surface of the locating rib 63. The gap or gaps correspond to locating-member-side void-escape holes.

Twenty-Eighth Embodiment

A twenty-eighth embodiment of this invention is similar to one of the first to twenty-first embodiments thereof except that a high pressure is applied to the interior of the housing 2 via the wide-mouthed portion 20 after epoxy prepolymer and curing agent are injected thereinto. The high pressure forces voids to escape from the epoxy prepolymer and curing agent.

Twenty-Ninth Embodiment

A twenty-ninth embodiment of this invention is similar to one of the first to twenty-first embodiments thereof except that epoxy prepolymer and curing agent are injected into the housing 2 while the interior of the housing 2 is evacuated. In this case, it is possible to surely remove voids from the injected epoxy prepolymer and curing agent.

What is claimed is:

1. An ignition coil comprising:

a housing;

a central core portion located in the housing;

an inner spool disposed in the housing and located outward of the central core portion;

a first winding provided on the inner spool;

an outer spool disposed in the housing and located outward of the inner spool;

a second winding provided on the outer spool;

a locating member including a locating rib positioned adjacent to an upper portion of the central core portion, the locating rib being provided in a gap between the inner spool and the central core portion and locating the inner spool and the central core portion relative to each other;

insulating resin injected into the housing and providing insulation among parts in the housing;

wherein at least one of the inner spool and the locating member has a void-escape passage which connects the gap and an outside of the inner spool with each other, and which allows a void to escape from the injected insulating resin in the gap.

2. An ignition coil as recited in claim 1, wherein the void-escape passage includes a spool-side void-escape hole formed in the inner spool and extending between an inner circumferential surface and an outer circumferential surface of the inner spool.

3. An ignition coil as recited in claim 1, wherein the void-escape passage includes a spool-side void-escape slit formed in the inner spool and extending between an inner circumferential surface and an outer circumferential surface of the inner spool, the spool-side void-escape slit opening at a top surface of the inner spool.

4. An ignition coil as recited in claim 1, wherein the void-escape passage includes a locating-member-side void-escape hole formed in the locating member and extending through a wall of the locating member at a place inward of the locating rib, the locating-member-side void-escape hole connecting the gap and an outside of the housing.

5. An ignition coil as recited in claim 1, wherein the void-escape passage is formed in the inner spool, and the locating rib has an auxiliary void-escape passage extending between an inner circumferential surface and an outer circumferential surface thereof and communicating with the void-escape passage.

6. An ignition coil as recited in claim 1, wherein the central core portion has a resilient member at its upper end.

7. An ignition coil as recited in claim 1, wherein the void-escape passage includes a spool-side void-escape recess formed in the inner spool.

8. An ignition coil as recited in claim 7, wherein the spool-side void-escape recess is formed in an inner circumferential surface of the inner spool.

9. An ignition coil as recited in claim 7, wherein the spool-side void-escape recess is formed in an upper end surface of the inner spool.

10. An ignition coil as recited in claim 1, wherein the void-escape passage includes a locating-member-side void-escape recess formed in the locating member.

11. An ignition coil as recited in claim 10, wherein the locating-member-side void-escape recess is formed in an outer circumferential surface of the locating rib.

12. An ignition coil as recited in claim 10, wherein the locating-member-side void-escape recess is near a base of the locating rib.

13. An ignition coil as recited in claim 1, wherein the void-escape passage includes a void-escape rib hole formed in the locating rib and extending between an inner circumferential surface and an outer circumferential surface of the locating rib.

14. An ignition coil as recited in claim 13, wherein the locating rib fits into a groove in the locating member.

15. An ignition coil as recited in claim 14, wherein the void-escape rib hole is located at a place where the locating rib fits into the groove in the locating member.

16. An ignition coil as recited in claim 13, wherein the void-escape rib hole communicates with a hole extending through a wall of the locating member.

17. An ignition coil as recited in claim 1, wherein an upper end of the central core portion has a small-diameter part, and the locating rib fits around the small-diameter part, and wherein the void-escape passage includes a wide gap defined between an outer circumferential surface of the locating rib and an inner circumferential surface of the inner spool.

* * * * *